US006297586B1

(12) United States Patent
Nakayama et al.

(10) Patent No.: US 6,297,586 B1
(45) Date of Patent: Oct. 2, 2001

(54) COLD-CATHODE POWER SWITCHING DEVICE OF FIELD-EMISSION TYPE

(75) Inventors: Kazuya Nakayama, Sagamihara; Tadashi Sakai, Yokohama; Naoshi Sakuma, Yokohama; Tomio Ono, Yokohama, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/263,217

(22) Filed: Mar. 5, 1999

(30) Foreign Application Priority Data

Mar. 9, 1998 (JP) ..... 10-056700
Mar. 16, 1998 (JP) ..... 10-065106

(51) Int. Cl.[7] ..... H01J 1/16
(52) U.S. Cl. ..... 313/336
(58) Field of Search ..... 313/306, 309, 313/336, 351, 495, 307, 308, 311

(56) References Cited

U.S. PATENT DOCUMENTS 5,499,938 3/1996 Nakamoto et al. .
5,977,693 * 11/1999 Nakamoto et al. ..... 313/336
6,057,636 * 5/2000 Sakai et al. ..... 313/336
6,097,138 * 8/2000 Nakamoto ..... 313/336

FOREIGN PATENT DOCUMENTS 4-284324 10/1992 (JP) .
6-36682 2/1994 (JP) .
7-21903 1/1995 (JP) .
7-182990 7/1995 (JP) .
7-254385 10/1995 (JP) .
8-115677 5/1996 (JP) .

* cited by examiner

*Primary Examiner*—Nimeshkumar D. Patel
*Assistant Examiner*—Todd Reed Hopper
(74) *Attorney, Agent, or Firm*—Oblon, Spivak, McClelland, Maier & Neustadt, P.C.

(57) ABSTRACT

Disclosed herein are a cold-cathode power switching device and a method of manufacturing the same. The device has a high voltage resistance and can be manufactured with high yield though its element area is large to control large currents. In the method, arrays of miniature emitters are prepared, and the emitter arrays are adhered to a conductive substrate having trenches. The conductive substrate is cut along the trenches, forming a plurality of substrates. The gaps between these substrates are filled with insulating resin. As a result, a multi-module power switching device for controlling large currents is manufactured with high yield. Further, cold-cathode modules, each having a gate pad, are arranged on a cathode electrode made of a conducive substrate, insulating strips are formed on the cathode electrode, gate lines are formed on the insulating strips, and the gate pads are connected to the gate lines. The electrons emitted from the modules can be controlled at a time. Each module may have a cathode pad connected to a cathode line. Depressions are made in those part of an anode electrode which oppose the gate pads and cathode pads, providing a sufficient insulation distance between each emitter and the anode electrode. Hence, a cold-cathode power switching device of field emission type can be provided which has a high voltage resistance.

13 Claims, 13 Drawing Sheets

COLD-CATHODE POWER SWITCHING DEVICE OF FIELD-EMISSION TYPE

BACKGROUND OF THE INVENTION

The present invention relates to a cold-cathode power switching device of field emission type, and more particularly to a cold-cathode array substrate which has a plurality of cold-cathode modules of field emission type and which is suitable for use in a large-current, high-voltage power switching device, and also to a method of manufacturing a cold-cathode power switching device of field emission type.

Hitherto, cold-cathode devices of field emission type have been developed for use mainly in displays. A cold-cathode device of this type is used in a display, as a source of electron beams for illuminating the fluorescent screen of the display. Therefore, the current supplied to the device is small, and the voltage applied thereto is only 1 kV or less.

In recent years, it has been proposed that the cold-cathode device of field emission type be used as a power switching device. A power switching device needs to operate for current ranging from a few tens of amperes to several thousands of amperes and for voltages ranging from a few kilovolts to several hundreds of kilovolts.

To allow passage of a large current, a cold-cathode device of field emission type must have a relatively large device area. In order to facilitate emission of electrons, however, it is desirable that the cone-shaped cathode of the cold-cathode device have an extremely sharp tip. It is very difficult for the cold-cathode device, which is manufactured by microstructure process, not only to have a large device area but also to achieve uniform electron emission over the large device area. This is why the cold-cathode device of field emission type, hitherto made, is disadvantageous in terms of reliability and manufacturing yield.

When a high voltage of 1 kV or more is applied to the conventional cold-cathode device of field emission type, discharge takes place at an uneven part of the device, possibly resulting in malfunction or voltage breakdown of the cold-cathode device. Such an uneven part is formed, particularly in a cold-cathode device which is an active device having gate electrodes for supplying control signals. To prevent discharge, it is necessary to arrange the gate electrodes and gate wiring such an uneven part is not formed in the cold-cathode device.

There is a demand for a large-current, high-voltage cold-cathode power device of field emission type. To meet the demand, a multi-module device may be used which has a number of cold-cathode modules. The multi-module device needs complex gate wiring to connect the gate electrodes of the many cold-cathode modules. The complex gate wiring is likely to form an uneven part in the multi-module device, at which discharge may occur.

It is extremely difficult to use a multi-module cold-cathode device of field emission type as a power switching device. Thus, the demand for a large-current, high-voltage cold-cathode power device of field emission type has not been satisfied.

Cold-cathode devices of field emission type, which have a cold-cathode array substrate, may have high-speed response, good anti-radiation property and high heat resistance and which may operate for large current and high voltages. Researches have, therefore, been made of the cold-cathode devices with a cold-cathode array substrate, which have these advantageous features.

Research and development of a cold-cathode device of field-emission type was started by K. R. Shoulders et al. at Stanford Research Institute (SRI), who proposed a tunnel effect vacuum triode in their thesis "Microelectronics using electron-beam-activated machining techniques," Advances in Computers, Voltage. 2, pp. 135–293, 1961. This field of art came to attract attention of many researchers when C. A. Spindt of SRI published a report on cold cathodes having a thin film (see J. Appl. Phys. 39, p. 3504, 1968).

A cold-cathode device of field emission type comprises an emitter electrode, an anode electrode, a cone-shaped emitter, and a gate electrode. When a high voltage is applied between the emitter electrode and the anode electrode, the emitter emits electrons, whereby main current flows. The main current is controlled by supplying a control signal to the gate.

The cone-shaped emitter is a miniature metal emitter. How the miniature metal emitter is made, along with the gate, by so-called "Spindt method" will be explained, with reference to FIGS. 1A to 1C. The Spindt method is most widely used at present. In this method, rotational grazing vapor deposition and aluminum (Al) sacrifice layer etching are performed.

As shown in FIG. 1A, a gate insulating film 6 is formed on a silicon substrate 1*a*. A gate layer 4*a*, which is a thin metal film, is formed on the gate insulating film 6. The gate insulating film 6 is etched by using the gate layer 4*a* as a mask. An opening is thereby made in the gate insulating film 6.

Next, as shown in FIG. 1B, Al is deposited on the gate layer 4*a* by effecting rotational grazing vapor-deposition at a small grazing angle $\phi$. An Al sacrifice layer 31 is thereby formed on the gate insulating film 6. Since the grazing angle is small as shown in FIG. 1B, Al is deposited on the gate layer 4*a* only, not on the silicon substrate 1*a* at all.

Then, as shown in FIG. 1C, molybdenum (Mo) vapor is applied in vertical direction onto the silicon substrate 1*a* through the opening made in the film 6. Mo is thereby deposited on the substrate 1*a*, forming an emitter 26. The emitter 26 is shaped like an acute cone, because the opening made in the Al sacrifice layer 31 gradually narrows as the deposition of Mo proceeds on the Al sacrifice layer 31.

The method of forming a miniature metal emitter, which Gray et al. has proposed, will be described with reference to FIGS. 2A to 2C.

First, as shown in FIG. 2A, an $SiO_2$ etching mask 32 is formed and patterned on a silicon substrate 1*a*. As shown in FIG. 2B, anisotropic wet etching solution is applied, thereby etching the silicon substrate 1*a* along the crystal plane. The silicon substrate 1*a* is thereby etched at its upper surface, except that part which is located beneath the $SiO_2$ etching mask 32. As the anisotropic etching further proceeds, that part of the substrate 1*a* assumes a shape like a pyramid, and the $SiO_2$ etching mask 32 is removed from the silicon substrate 1*a*. As a result, a pyramid-shaped miniature silicon emitter 1*b* is formed, which protrudes from the silicon substrate 1*a*.

Next, a gate insulating film 6 is deposited on the silicon substrate 1*a*, and a gate layer 4*a* is deposited on the gate insulating film 6. As shown in FIG. 2C, an opening is made in that part of the gate layer 4*a* which is located above the miniature silicon emitter 1*b*. Selective etching is performed on the gate insulating film 6 by using the gate layer 4*a* as a mask. An opening is thereby formed in the gate insulating film 6 exposing the miniature silicon emitter 1*b*.

The Spindt method and the Gray et al. method, described above, include microstructure process. It is therefore very difficult to form a number of miniature emitters on the silicon substrate, with a sufficiently high yield. No practical assembling methods that can arrange many cold-cathode tips in the form of an array.

A number of cold-cathode tips may be formed on a cold-cathode array substrate for use in a power device by these method. If any one of the miniature emitters is short-circuited with the gate layer, however, the cold-cathode array substrate will become useless in its entirety. This reduces the manufacturing yield of the cold-cathode array substrate.

The cold-cathode array substrate has projections protruding from its periphery. Like the miniature emitters, the projections are likely to emit electrons. If the projections emit electrons, a leakage current is generated, eventually degrading the voltage resistance of the power device comprising the cold-cathode array substrate. It should be noted that the gate layer cannot control the leakage current.

The silicon substrate 1*a* of Gray acts as the series resistance on the main current flowing in the miniature emitters 1*b* formed by etching the surface of the substrate 1*a*. This decreases the operating speed of the power device. Should the temperature of the power device rise while the device is operating, the tip of every miniature silicon emitter 1*b* would degrade and the service time of the power device will become short.

The Gray et al. method is less complicated than the Spindt method (FIGS. 1A to 1C) in which miniature metal emitters 26 are formed by depositing Mo on the silicon substrate 1*a*. However, the tips of the emitters 1*b* are likely to degrade as the temperature of the silicon substrate 1*a* of the power device rises, ultimately shortening the service time of the power device.

The tips of the miniature metal emitters 26 made of Mo and formed by the Spindt method also degrade as the power device in which the emitters 26 are provided generates much heat while operating. This is inevitable because the substrate 1*a* is made of silicon.

As described above, the current density in any conventional cold-cathode device of field emission type cannot be increased, because much heat will be generated in the substrate if the current density is high. The cold-cathode device cannot be modified to operate for large current and high voltages. In view of this, the possibility is slim that the conventional cold-cathode devices are used as switching devices.

BRIEF SUMMARY OF THE INVENTION

The general object of the present invention is to provide a cold-cathode power switching device of field emission type, which can control large currents, and to a method of manufacturing this cold-cathode power switching device.

As described above, the conventional cold-cathode device having a silicon substrate and miniature emitters provided on the silicon substrate is disadvantageous in that the current density decreases due to the series resistance in the silicon substrate and the service time is shortened due to the temperature rise. The conventional method of manufacturing a cold-cathode device is disadvantageous, too. Any cold-cathode array substrate made by the conventional method has relatively large projections and recesses in its surface. Discharge inevitably takes place between the projections and recesses and the anode electrode.

The present invention has been made in view of the disadvantage of the conventional cold-cathode device and that of the conventional method of manufacturing a cold-cathode device. The first object of the invention is to provide a cold-cathode array substrate which has a plurality of cold-cathode modules of field emission type, which has a long service life, which can be manufactured at high yield and which can be easily assembled and tested, and to provide a method of manufacturing this cold-cathode array substrate.

Each of the cold-cathode modules according to the invention has an emitter conductor layer including a plurality of miniature emitters, which are arranged in high density, forming a matrix array. The emitter conductor layer is soldered to a module substrate having high electrical conductivity, with a low-melting solder alloy.

The cold-cathode modules can be made easily with high yield, can have a long service time, and can be tested easily.

According to the present invention, a plurality of cold-cathode modules are arranged in rows and columns on a conductive supporting substrate having high electrical conductivity and high thermal conductivity. Insulating strips are formed on the conductive supporting substrate, which serves as a cathode electrode. Gate lines and cathode lines are formed on these insulating strips. The gates and cathodes of all cold-cathode modules are controlled at a time, by the use of these gate lines and cathode lines.

The second object of the present invention is to provide a cold-cathode power switching device of field emission type, which comprises a cathode electrode made of a cold-cathode module array excelling in evenness, and an anode electrode opposing the cold-cathode and having means to ensure resistance against the voltage applied between the cathode electrode and the anode electrode, and to provide a method of assembling the cold-cathode power switching device of the field emission type.

More precisely, the cold-cathode power switching device of field emission type, which comprises a plurality of field-emission type cold-cathode modules and a common anode electrode opposing the plurality of field-emission type cold-cathode modules. Each of the field-emission type cold-cathode modules comprises a substrate, a plurality of field-emission type emitters provided on the substrate, a gate insulating film provided on the substrate, and a gate electrode provided on the gate insulating film.

Preferably, this cold-cathode power switching device is designed to operate as a switching element.

Also preferably, the substrates of the modules may be electrically isolated from each other by isolating material filled in gaps between the substrates but physically connected to each other, and the gate electrodes of the modules may be connected to each other by conducting films.

Desirably, all the substrates of the modules are selected good ones.

Preferably, an emitter electrode is provided on a reverse side of the substrate of each field-emission type cold-cathode module.

Still preferably, the cold-cathode power switching device further comprises a supporting substrate which is made of conductor, which supports the field-emission type cold-cathode modules, and which imparts a common emitter potential to the field-emission type emitters of the field-emission type cold-cathode modules.

In the cold-cathode power switching device of field emission type, according to the invention, the substrates of the modules may preferably be electrically isolated from each other by isolating material filled in gaps between the substrates but physically connected to each other, and the gate electrodes of the modules may be connected to each other by conducting films.

In the cold-cathode power switching device of field emission type, according to the invention, the gate insulating films is provided in the form of a single layer covering all modules, and the gate electrodes are provided in the form of a single layer covering all modules.

Preferably, an emitter electrode is provided on a reverse side of the substrate of each field-emission type cold-cathode module.

Also preferably, the emitter electrode is provided on the substrate of each good module only, and an emitter potential is applied to field-emission type emitters through the emitter electrode and the substrate of the module.

The cold-cathode power switching device of field emission type, according to the invention, further comprises a supporting substrate supporting the field-emission type cold-cathode modules, gate lines provided between the field-emission type cold-cathode modules, and wires connecting the gate electrodes of the field-emission type cold-cathode modules to the gate lines.

Preferably, depressions are made in those parts of the common anode electrode which oppose regions between the field-emission type cold-cathode modules.

Desirably, the cold-cathode power switching device further comprises cathode lines provided between the field-emission type cold-cathode modules, and cathode-connecting wires connecting the cathode lines to the cathode electrodes of the modules and also connecting the cathode lines to the emitter electrodes of the field-emission type cold-cathode modules.

Also preferably, the cold-cathode modules of field emission type are set in a lattice-shaped positioning frame provided on the supporting substrate.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will be described in detail, with reference to the accompanying drawings.

Figure 3A:
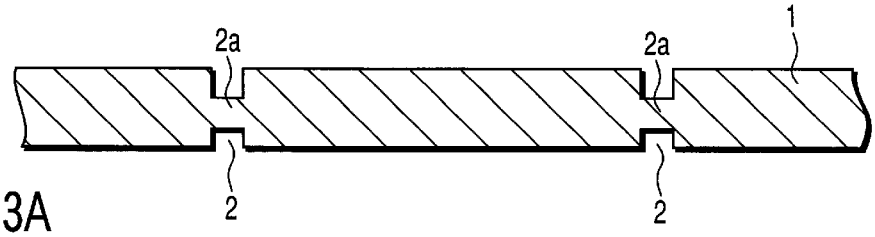
FIGS. 3A to 3O are sectional views showing a cold-cathode power switching device of field emission type, which is a first embodiment of the present invention, and explaining a method of manufacturing the cold-cathode power switching device.
Figure 3B:
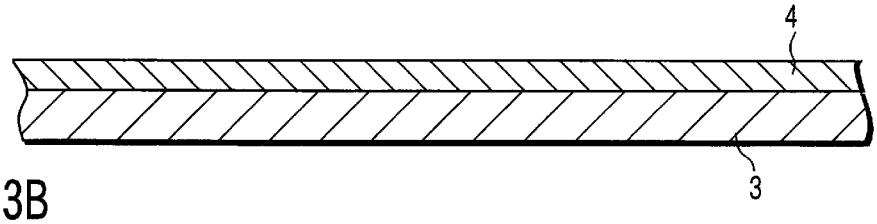
Figure 3C:
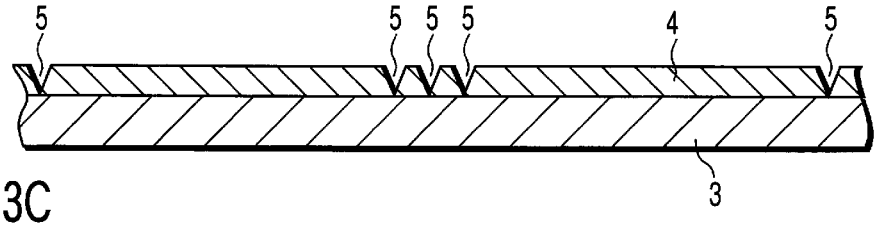
Figure 3D:
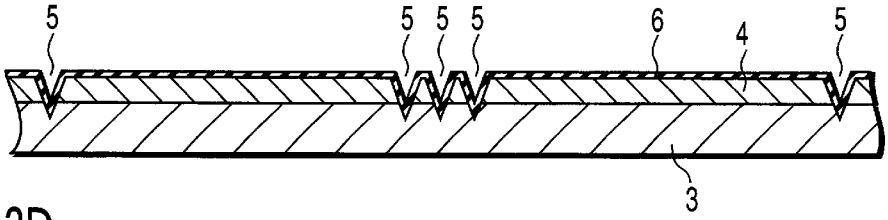
Figure 3E:
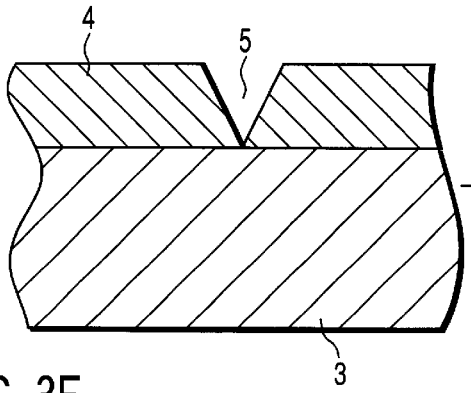
Figure 3F:
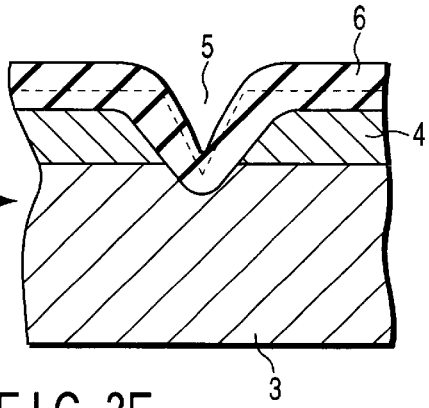
Figure 3G:
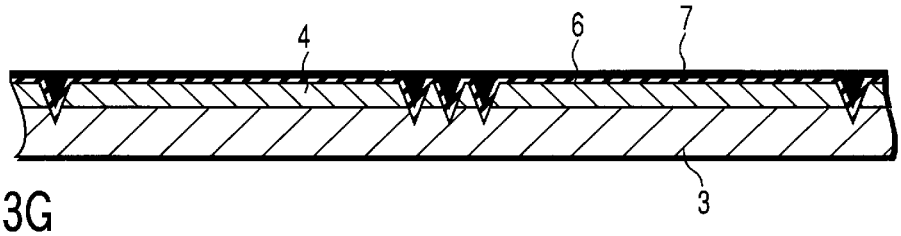
Figure 3H:
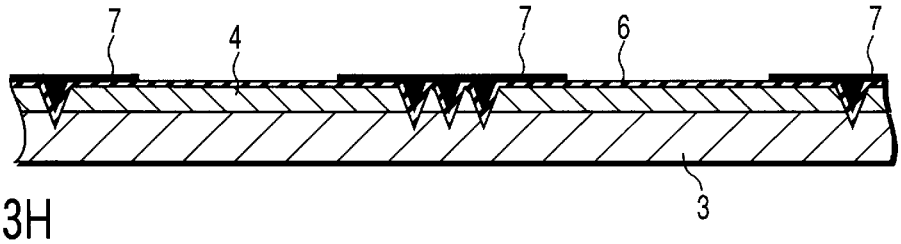
Figure 3I:
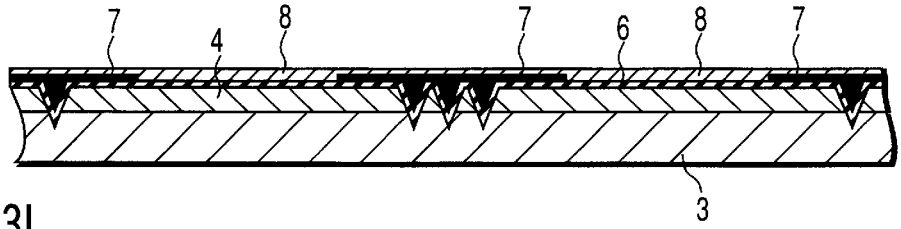
Figure 3J:
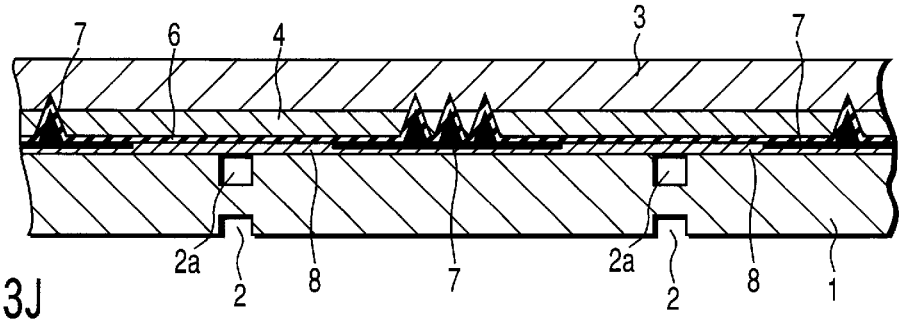
Figure 3K:
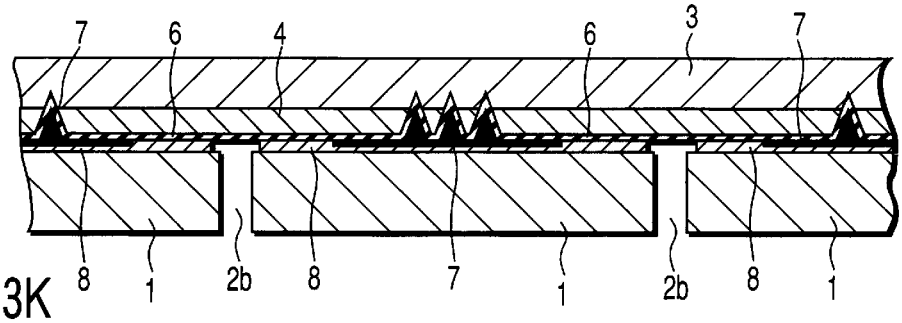
Figure 3L:
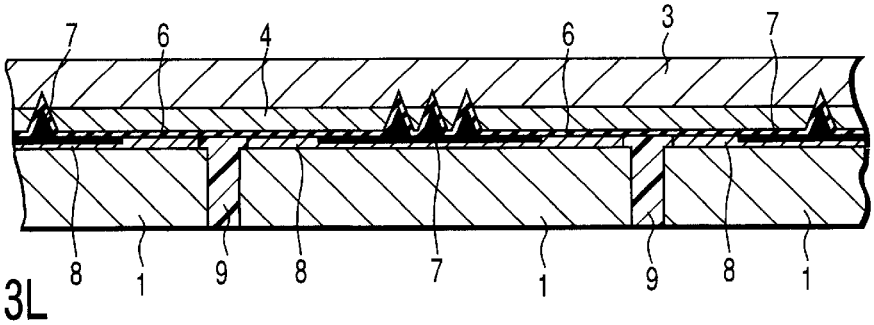
Figure 3M:
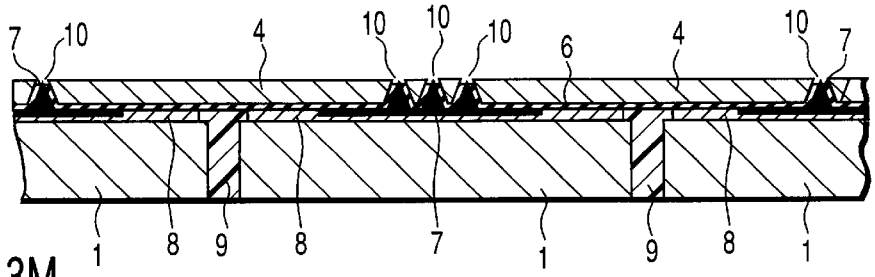
Figure 3N:
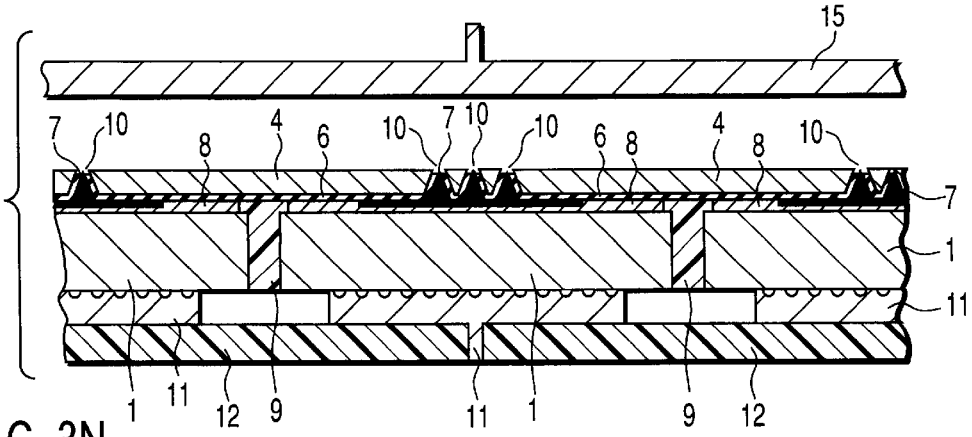
Figure 3O:
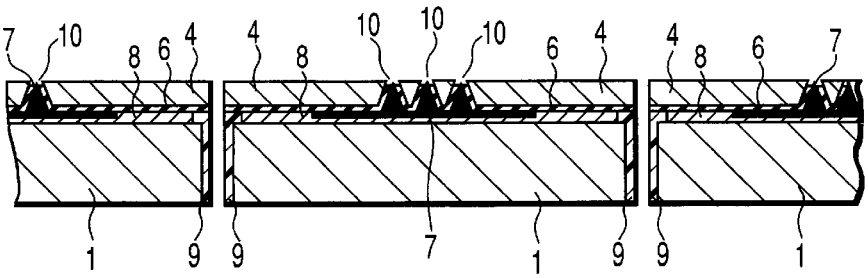

FIGS. 3A to 3O are sectional views, showing the structure of a cold-cathode power switching device according to the first embodiment and explaining the method of manufacturing the cold-cathode power switching device.

As shown in FIG. 3A, a module substrate 1 is prepared, which is made of silicon or metal such as Cu, Al or stainless steel. First trenches 2 are cut in the lower surface of the module substrate 1 along dicing lines. Second trenches 2*a* are cut in the upper surface of the module substrate 1, also along the dicing lines. The substrate 1 will be cut along the dicing lines, into a plurality of modules.

The trenches 2 and 2*a* may be cut in the surfaces of the module substrate 1, first by machining and then by additional process, such as etching or polishing, to remove burr formed during the machining. Alternatively, the trenches 2 and 2*a* may be cut in the surfaces of the substrate 1, either by dry etching or by wet etching.

For instance, the substrate 1 is 500 $\mu$m thick. The first trenches 2 are 200 $\mu$m wide and 50 $\mu$m deep from the lower surface of the substrate 1. The second trenches 2*a* are 200 μm wide and 100 μm deep from the upper surface of the substrate 1.

As shown in FIG. 3B, a silicon mold substrate 3 is prepared. The silicon mold substrate 3 is made of p-type silicon. Phosphorus (P) ions are implanted, in high concentration, into the silicon mold substrate 3. An $n^+$-type silicon gate layer 4 is thereby formed in the upper surface of the silicon mold substrate 3. Here, "$n^+$" indicates that n-type impurities are doped in high concentration.

Having high impurity concentration, the silicon gate layer 4 has high conductivity. The layer 4 can therefore serve to form a gate, which controls the main current in the cold-cathode power switching device of field emission type.

Next, as shown in FIG. 3C, miniature emitter molds 5, each shaped like an inverted pyramid, are formed in the silicon gate layer 4. The miniature emitter molds 5 are depressed molds, in which conductor material will be buried to form miniature emitters. The molds are arranged in rows and columns, forming a matrix array. How the miniature emitter molds 5 are formed will be described below.

An etching mask (not shown) made of $SiO_2$ is formed on the silicon gate layer 4 which extends parallel to (100) crystal plane. Square openings are made in the etching mask, arranged in rows and columns forming a matrix array. The four sides of each square opening are parallel to crystal axes that are equivalent to <110> axis. By using the $SiO_2$ etching mask having the square openings, etching solution having high crystal plane selectivity is applied, forming anisotropic etching on the silicon gate layer 4. As a result, miniature emitter molds 5 in the silicon gate layer 4, which are shaped like an inverted pyramid and arranged in rows and columns. The sloping sides of each mold 5 are all crystal planes equivalent to (111) plane. Therefore, the miniature emitter molds 5 are formed with high precision and high reproducibility and have design shape and size.

Then, as shown in FIG. 3D, thermal oxidation is performed at the surface of the silicon gate layer 4, thereby forming a thermal oxide film 6 made of $SiO_2$. The oxide film 6 covers not only the surface of the silicon gate layer 4 but also the sides of each miniature emitter mold 5. The oxide film 6 serves to separate the silicon gate layer 4 from an emitter conductor layer 7 (FIG. 3G) which will be formed by burying conductive material such as Mo in the emitter molds 5. The oxide film 6 also serves to sharpen the apex of each mold 5 as will be later described with reference to FIG. 3F. Why the thermal oxide film 6 serves these two purposes will be explained below.

As mentioned above and as can be understood from FIG. 3E, the sides of each miniature emitter mold 5 are crystal planes equivalent to (111) plane. The apex angle of each mold 5 has a predetermined value. Since each emitter mold 5 is used to form a field-emission type emitter, it is desirable that the apex of the mold 5 be further sharpened in order to intensity field concentration.

Thereafter, as shown in FIG. 3F, the oxide film 6 grows thicker as the thermal oxidation advances toward the lower surface of the silicon gate layer 4. Finally, the lowest part of the oxide film 6 protrudes into the upper surface of the p-type silicon mold substrate 3. That part of the oxide film 6 which exists in the substrate 3 will be later removed by etching, together with the silicon mold substrate 3, as shown in FIG. 3M, to form an electron-emitting opening in the silicon gate layer 4, in self alignment with a field-emission type emitter. The volume of the $SiO_2$ film 6 increases as the oxidation proceeds at its surface, narrowing the apex of the miniature emitter mold 5 as shown in FIG. 3F.

Further, as shown in FIG. 3G, an emitter conductor layer 7 made of Mo is deposited by sputtering on the silicon gate layer 4, filling up the miniature emitter molds 5. In other words, the emitter conductor layer 7 is formed by means of replicate molding method, filling the miniature emitter molds 5 with conductive material and forming miniature emitters in the molds 5. The material of the emitter conductor layer 7 is not limited to Mo. The layer 7 may be made of any other high-melting metal such as tungsten (W) or some other materials such as TiN, $LaB_6$, BN, AlN, GaN, diamond and diamond-like carbon.

Next, a thin adhesive film (not shown) made of Ti, Cu or the like is formed on the emitter conductor layer 7. As is illustrated in FIG. 3H, both the emitter conductor layer 7 and the adhesive film are patterned, forming miniature emitter arrays. Each miniature emitter array will become a component of a cold-cathode module as will be described later. The step of patterning or separating layer 7 and the adhesive film into parts is important, because it makes it easy to completely etch away those parts of a solder alloy layer 8 (FIG. 3K) which are exposed to the second trenches 2*a* made in the upper surface of the module substrate 1.

The emitter conductor layer 7 may be made of material that is more easily etched than Mo. If this is the case, the emitter conductor layer 7 can be removed in the step of removing the solder alloy layer 8. Thus, there is no need for an independent step of removing the emitter conductor layer 7.

Then, as shown in FIG. 3I, the solder alloy layer 8 made of alloy such as Pb-Sn or Au-Sn is formed partly on the oxide film 6 and partly on the emitter conductor layers 7 (i.e., miniature emitter arrays). As shown in FIG. 3J, the structure shown in FIG. 3I is turned over and placed on the module substrate 1, with the solder alloy layer 8 set in contact with the substrate 1. The structure is so positioned that the miniature emitter arrays do not overlap the first trenches 2 or second trenches 2*a* made in the surfaces of the module substrate 1. The structure is then soldered to the substrate 1, with the miniature emitters of each array projecting upwards as shown in FIG. 3J.

As shown in FIG. 3K, the portions of the module substrate 1, in which the trenches 2 and 2*a* are made, are cut and removed, without damaging the silicon gate layer 4 that is provided on the silicon mold substrate 3. More precisely, said portions of the substrate 1 are removed by dicing, whereby the substrate 1 is divided into a plurality of square module substrates. As a result of the dicing, slits 2*b* reaching the solder alloy layer 8 from below are cut in the module substrate 1.

Since the module substrate 1 has already has the first trenches 2 and the second trenches 2*a*, it can be readily cut into square module substrates, without forming burr or the like. If the dicing is effected with high precision, the substrate 1 can be cut into a plurality of module substrates even if it have trenches in the lower surface only. In this case, however, the surface of the silicon gate layer 4 is likely to be damaged.

Further, etching solution is applied through the slits 2*b* made in the silicon module substrate 1, thereby over-etching those parts of the solder alloy layer 8, which are exposed to the slits 2*b*. As a result, those parts of the oxide film 6 formed on the silicon gate layer 4 are exposed. Slits 2*b* are thereby made in the solder alloy layer 8.

As shown in FIG. 3L, the slits 2*b* which separate the substrate 1 into square module substrates and reach the oxide film 6, are filled with insulating material. As a result, insulating plugs 9 are formed in the slits 2*b*, connecting the square module substrates into one body. More specifically, plasma CVD is first performed at a low temperature, forming an SiN film on the inner surfaces of each slit 2*b*. Then, resin (i.e., insulating material) is applied, filling the slits 2*b*, and hardened, forming the insulating plugs 9. The SiN film covering the inner surfaces of each slit 2*b* serves a passivation, which prevents moisture from entering the emitter conductor layer 7 located above the slit 2*b*.

The insulating material applied into the slits 2*b* is heat-resistant polyimide, epoxy resin, ceramic paste, low-melting glass, or the like. The material may be applied to fill the slits 2*b* by the use of a squeeze. Alternatively, the material may be drawn into the slits 2*b* from the sides of the substrate 1 under reduced pressure after removable tape has been adhered to the upper and lower surfaces of the substrate 1. It should be noted that a squeeze is a jig designed to force a filler into gaps.

The sides of the module substrate 1 must be covered with insulating layers. To this end, plasma melting spray, ceramic plaiting, or the like may be carried out. If the substrate 1 is made of Al, it is immersed in acid solution, whereby its surfaces and sides are anodized and covered with insulating film. In this case, slight mechanical polishing is performed at the lower surface of the substrate 1, removing the insulating film therefrom. This is because the lower surface of the substrate 1 must be exposed to effect the following manufacturing step (FIG. 3N).

Next, as shown in FIG. 3M, the p-type silicon mold substrate 3 is removed by electrochemical etching, leaving the $n^+$-type silicon gate layer 4 on the emitter conductor layer 7. The electrochemical etching removes the $n^+$-type silicon gate layer 4 only, because p-type silicon and $n^+$-type silicon differ in terms of etching rate. Further, the electrochemical etching forms electron-emitting opening 10 in the silicon gate layer 4, in self alignment with the field-emission type emitters. As a result, an array of cold-cathode modules is made, which is an integrated unit of wafer size.

The module array thus formed is covered with the silicon gate layer 4. Therefore, the emitter conductor layer 7 cannot be seen when the structure of FIG. 3M is looked from above, and only the field-emission emitters are seen because they are exposed through the electron-emitting opening 10 made in the silicon gate layer 4. The cold-cathode modules are electrically isolated from one another by the oxide film 6 (i.e., gate insulating film) and the insulating plugs 9 formed in the slits 2*b*.

As shown in FIG. 3N, emitter electrodes 11 fixed to an insulating plate 12 and provided for the cold-cathode modules, respectively, are set in contact with the lower surface of the silicon module substrate 1. To test the modules, the resultant structure is placed in a vacuum chamber, along with an anode electrode 15. In the vacuum chamber, the cold-cathode modules are positioned, opposing the anode electrode 15. The cold-cathode modules can be easily tested, without providing gate contacts for them.

Gate contacts must be provided to test the cold-cathode modules incorporated in the conventional cold-cathode array substrate, because the modules are formed on a substrate that is solid, having no slits at all. Hence, wires must be connected to the gates of the cold-cathode modules in order to determine whether failure, such as gate-emitter short circuit, has occurred in the manufacturing steps. Due to the gate wires, irregular projections are formed on the upper surface of each cold-cathode module, inevitably causing discharge between the module and the anode electrode used in the test. The discharge not only breaks down the elements of the module, but also causes the parts of the module other than emitters to emit electrons. The electron emission, which the gate electrode cannot control, impairs the reliability of the device.

In the manufacture of the cold-cathode power switching device according to the first embodiment of the invention, the structure shown in FIG. 3M is cut along the slits 2*b* made in the module substrate 1 after the cold-cathode modules have been tested as shown in FIG. 3N. More precisely, the structure of FIG. 3M is cut as shown in FIG. 3O, leaving insulating films 9 on the sides of each piece of the module substrate 1. As a result, a cold-cathode array substrate is manufactured, which has a plurality of tested cold-cathode modules arranged in rows and columns, forming an array.

The cold-cathode array substrate thus manufactured has already qualified by testing for each constituent cold-cathode module. Since the entire cold-cathode module array is covered with the silicon gate layer 4, except the field-emission emitters, the cold-cathode array substrate has a flat upper surface. Further, no excessive discharge will occur, except at the field-emission emitters. Nor will leakage current flow, except from the field-emission emitters. This is because the sides of the cathode, which is composed of the module substrate 1 and the solder alloy layer 8, are covered with the insulating films 9 which are left after the structure of FIG. 3M has been cut into a plurality of cold-cathode modules.

As described above, the emitter electrodes 11 provided for the cold-cathode modules, respectively, are set in contact with the lower surface of the module substrate 1, thereby testing the cold-cathode modules. If any one of the cold-cathode modules is found to have failed in normal operation, it may be electrically disconnected from the cold-cathode module array. In this case, the other cold-cathode modules can operate continuously.

In the case of the conventional cold-cathode array substrate, all cold-cathode modules can no longer be used if failure, such as gate-emitter short circuit, occurs in any one of modules. In the cold-cathode array substrate according to the present invention, once such a failure takes place in any one of the cold-cathode modules, all other modules can be used.

Figure 4A:
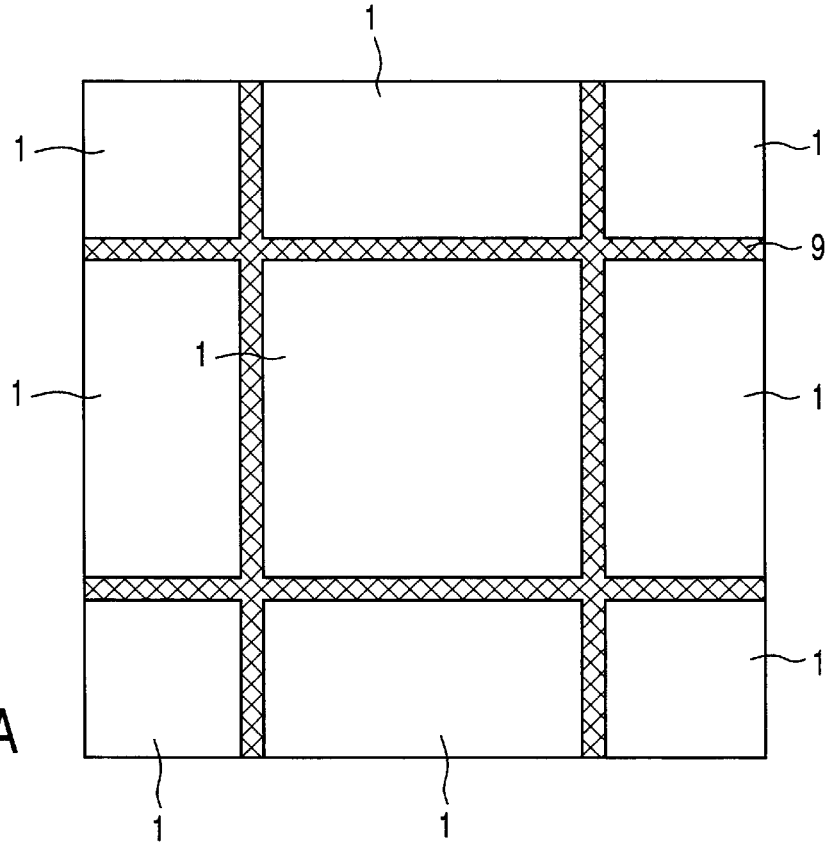
FIGS. 4A and 4B are bottom plan view and top plan view, respectively, of the cold-cathode module array incorporated in the first embodiment of the invention.
Figure 4B:
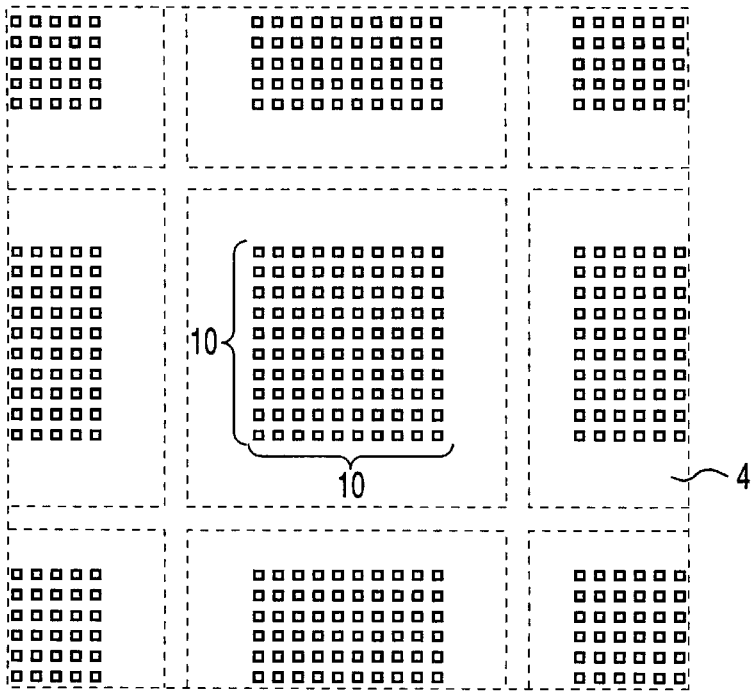

FIG. 4A is a bottom plan view of the cold-cathode array substrate shown in FIG. 3M. FIG. 4B is a top plan view thereof. FIG. 4A shows the cold-cathode modules arranged on the module substrate 1, which are physically connected and electrically isolated by the insulating plug material 9. FIG. 4B shows the silicon gate layer 4 which covers all cold-cathode modules. As shown in FIG. 4B, the silicon gate layer 4 has electron-emitting opening 10, which expose the miniature emitters made of the emitter conductor layers 7 of every cold-cathode module.

FIGS. 5A to 5D are sectional views showing a cold-cathode power switching device of field emission type, which is a second embodiment of the present invention, and explaining a method of manufacturing the cold-cathode power switching device;

The structure of a cold-cathode power switching device of field emission type, which is the second embodiment of the invention, and a method of manufacturing the second embodiment will be described, with reference to FIGS. 5A to 5D.

Figure 5A:
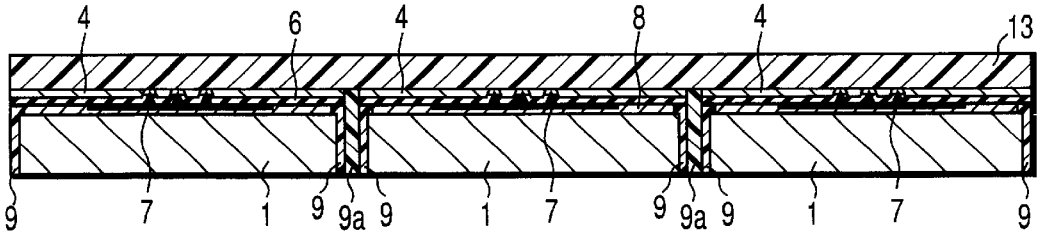
FIGS. 5A to 5D are sectional views showing a cold-cathode power switching device of field emission type, which is a second embodiment of the present invention, and explaining a method of manufacturing the cold-cathode power switching device.

As shown in FIG. 5A, cold-cathode modules which have been tested as shown in FIG. 3N and found to be good ones and which have been separated from one another by dicing as shown in FIG. 3O are arranged on an adhesive tape layer 13, spaced apart at predetermined intervals. The gaps between the cold-cathode modules thus arranged are filled with insulating plugs 9*a*. The insulating plugs 9*a* is made of material which releases as little gas as possible, such as heat-resistant epoxy resin, heat-resistant polyimide, low-melting glass, ceramic paste, or the like, which is used to fill up the slits 2*b* in the first embodiment.

Figure 5B:
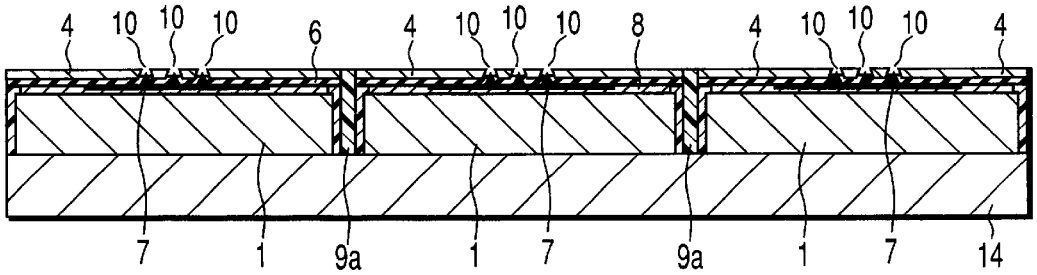
Figure 5C:
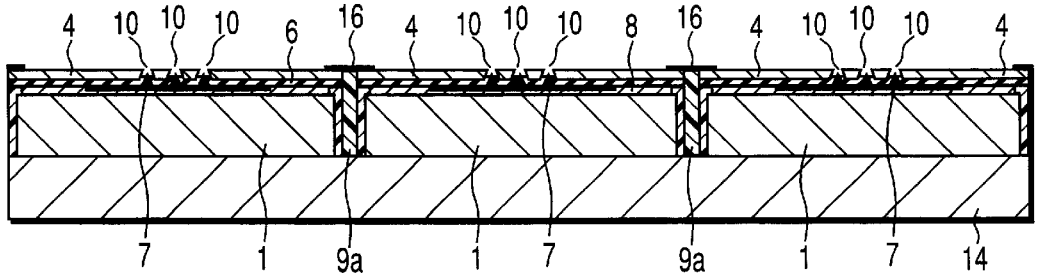

Thereafter, as shown in FIG. 5B, the cold-cathode modules arranged on the adhesive tape layer 13 are soldered to a cold-cathode array supporting substrate 14, and the adhesive tape layer 13 is peeled off. As shown in FIG. 5C, thin conductor layers 16 are vapor-deposited by means of thin film technology using a metal mask. The thin conductor layers 16 connect the silicon gate layers 4 provided respectively on the individual cold-cathode modules.

Figure 5D:
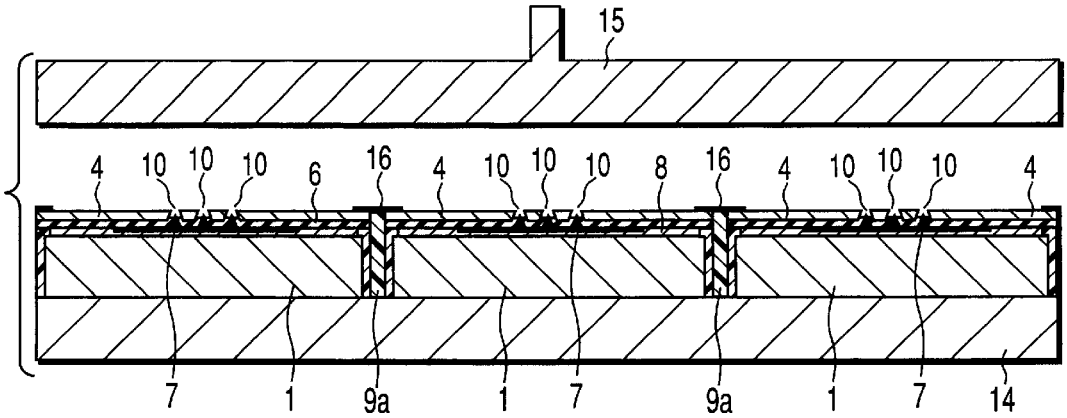

Next, as shown in FIG. 5D, an anode electrode 15 is arranged to face the cold-cathode modules provided on the cold-cathode array supporting substrate 14. The structure shown in FIG. 5D is operated, by using the cold-cathode modules, or more specifically the supporting substrate 14, as a cathode electrode. Since no gate wiring is provided on the array of the cold-cathode modules, the cathode electrode has a flat upper surface. Therefore, no discharge will occur, except at the field-emission emitters. Nor will leakage current flow, except from the field-emission emitters.

The cold-cathode modules may be formed by another method. More specifically, the module substrate 1 is soldered to the cold-cathode array supporting substrate 14 with solder alloy. Then, the entire surface of the cold-cathode array supporting substrate 14 is covered with an adhesive sheet that can be peeled off. Insulating material is drawn into the slits 2*b* from the sides of the substrate 1 under reduced pressure and is hardened in the slits 2*b*. After the insulating material has been hardened completely, the adhesive sheet is peeled from the cold-cathode array supporting substrate 14. Thin conductor layers 16 are vapor-deposited by means of thin film technology using a metal mask. The thin conductor layers 16 connect the silicon gate layers 4 provided respectively on the individual cold-cathode modules. In this case, it is desired that low ridges having the same size as the cold-cathode modules be formed on the cold-cathode array supporting substrate 14.

The structure of a cold-cathode power switching device of field emission type, which is the third embodiment of the invention, and a method of manufacturing the third embodiment will be described, with reference to FIGS. 6A, 6B and FIG. 7.

Figure 6A:
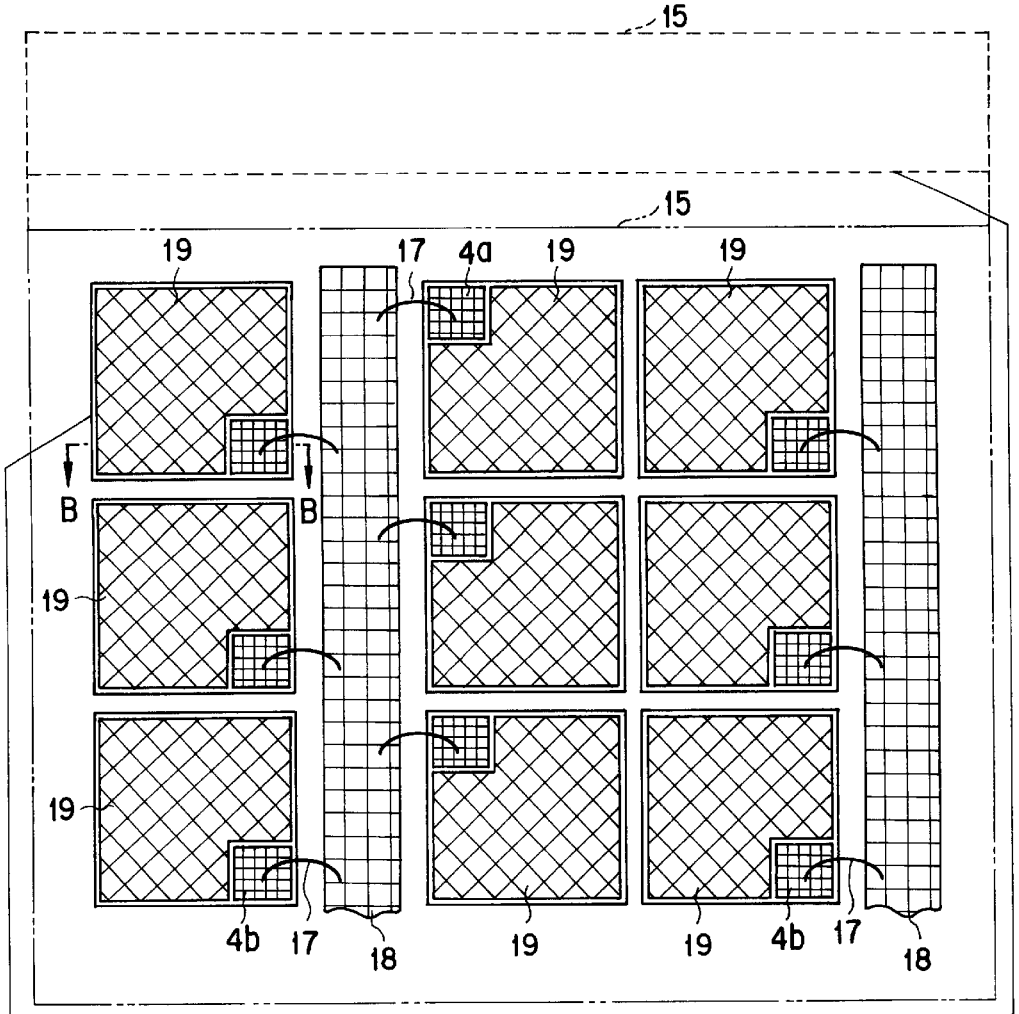
FIGS. 6A and 6B are plan view and sectional view, respectively, of the cold-cathode power switching device of field emission type, which is a third embodiment of the invention.
Figure 6B:
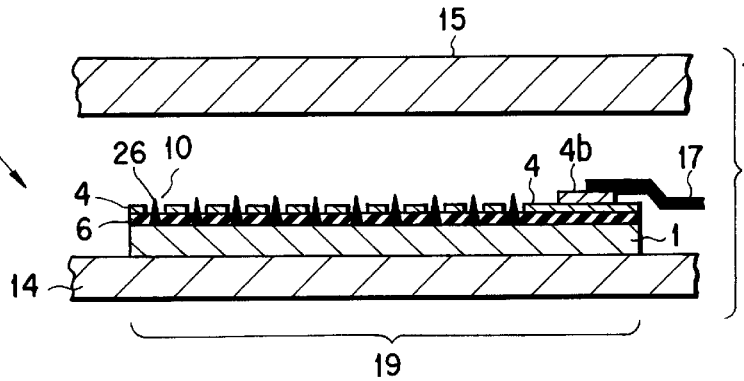

FIGS. 6A and 6B are plan view and sectional view, respectively, of the third embodiment. More correctly, FIG. 6A is a top view of a cold-cathode module array provided on a cold-cathode array supporting substrate 14, which is a conducting substrate.

As shown in FIG. 6A, the cold-cathode module array comprises a plurality of cold-cathode modules 19, a plurality of gate pads 4*b*, gate lines 18, and gate-connecting wires 17. The modules 19 are arranged on the cold-cathode array supporting substrate 14 (FIG. 6B), forming a matrix array. The gate pads 4*b* are formed on the modules 19, respectively. The gate lines 18 are provided on insulating strips 21, which are formed on the cold-cathode array supporting substrate 14 as illustrated in FIG. 7. The gate-connecting wires 17 connect the gate pads 4*b* to the gate lines 18.

The cold-cathode array supporting substrate 14 serves as common cathode electrode. As shown in FIG. 6B, a common anode electrode 15 is provided, facing the common cathode electrode, i.e., the array supporting substrate 14. In FIG. 6A, the common anode electrode 15 is indicated by alternate two-dot, dashed lines in FIG. 6A. And a side view of the anode electrode 15 is presented in the upper part of FIG. 6A.

FIG. 6B is a sectional view, taken along line B—B in FIG. 6A, and illustrates the positional relation of the cold-cathode modules 19, common cathode electrode (i.e., array supporting substrate 14) and common anode electrode 15. The array supporting substrate 14 and the anode electrode 15 are made of metal having high thermal conductivity and high electric conductivity, to increase the power level of the cold-cathode power switching device of field emission type.

As shown in FIG. 6B, each cold-cathode module 19 comprises a module substrate 1, a silicon gate layer 4, a gate pad 4*b*, an gate insulating film 6, a gate-connecting wire 17, and miniature emitters 26. The miniature emitters 26 protrude upwardly from the module substrate 1, penetrating through the gate insulating film 6. The silicon gate layer 4 has electron-emitting opening 10, which expose the tips of the miniature emitters 26. The gate insulating film 6 surround the emitters 26. The gate pad 4*b* is formed on one corner of the silicon gate layer 4. The gate line 18 (FIG. 6A) connects the gate pad 4*b* to one gate line 18 shown in FIG. 6A. The cold-cathode modules 19 are die-bonded to the array supporting substrate 14 and oppose the common anode electrode 15.

Figure 1A:
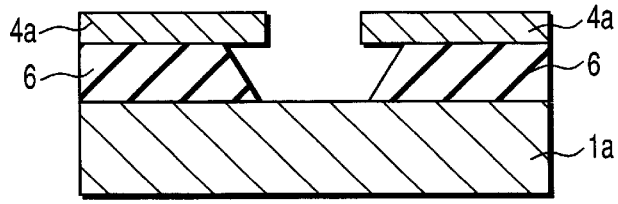
FIG. 1A (PRIOR ART)
FIGS. 1A to 1C are sectional views explaining the Spindt method of forming a cold-cathode emitter.
Figure 1B:
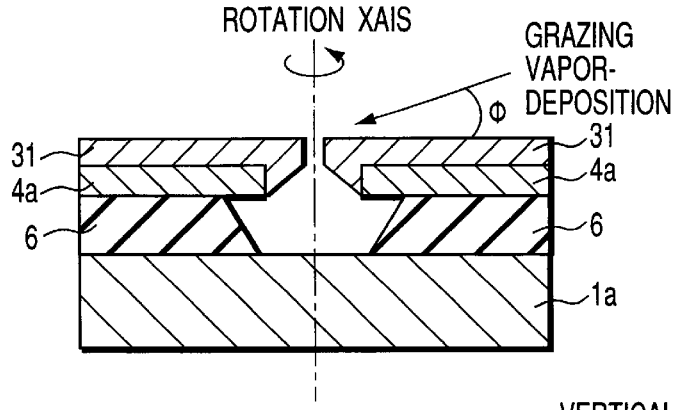
FIG. 1B (PRIOR ART)
Figure 1C:
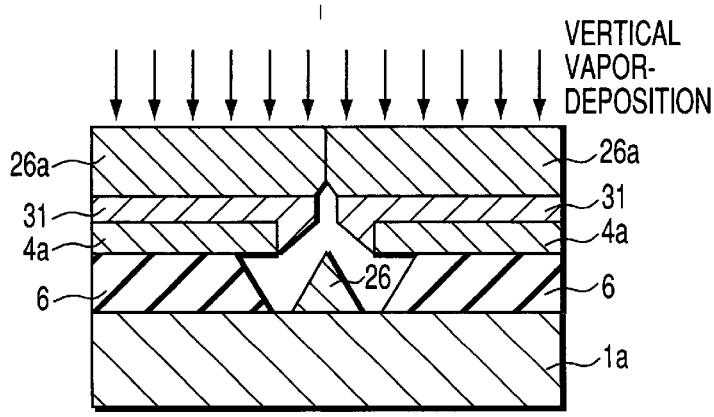
FIG. 1C (PRIOR ART)

In the cold-cathode power switching device of field emission type, the miniature emitters 26 of each cold-cathode module 19 are arranged, forming a matrix array, and may be made of an emitter conductor layer 7 as in the first and second embodiments. The emitters 26 may be formed by the conventional method such as the Spindt method or the Gray et al. method. Further, the silicon gate layer 4 may be, for example, such a metal gate layer 4*a* as is shown in FIG. 1A.

As illustrated in FIG. 6B, the silicon gate layer 4 provided on the gate insulating film 6 that is formed on the module substrate 1 (i.e., conducting substrate) is a continuous film. A control signal supplied to the gate line 18 from an external device is supplied to all gate pads 4*b* of the cold-cathode module array, controlling the emission of electrons from all miniature emitters 26 of the cold-cathode module array.

The gate wiring in the conventional cold-cathode device for use in displays totally differs from the gate wiring shown in FIG. 6A. Hitherto, gate electrodes are provided, each for one miniature emitter, because the emission of electrons is controlled in units of pixels to control the current flowing from the emitter, which is exposed through the electron-emitting opening 10.

In the cold-cathode power switching device of this invention, each cold-cathode module 19 having a plurality of miniature emitters 26 have one silicon gate layer 4, which controls the large-current switching operation. Therefore, it suffices to apply one control signal to the silicon gate layer 4 from the gate-connecting wire 17 through the gate pad 4*b*. Thus, the emission of electrons from all miniature emitters 26 of each cold-cathode module 19 can be controlled by a single control signal.

The gate lines 18 may be provided, each for one cold-cathode module 19. Alternatively, one gate line may be provided for one block composed of two or more modules 19 as shown in FIG. 6A. If so, the emission of electrons can be controlled in units of module blocks. Alternatively, only one gate line may be provided for the entire cold-cathode module array. In this case, the emission of electrons can be accomplished in the entire cold-cathode module array with a single control signal.

The cold-cathode power switching device of field emission type, which is depicted in FIGS. 6A and 6B, is placed in a vacuum chamber, in which a vacuum is maintained at $10^{-5}$ torr or less. Electrons emitted from the miniature emitters 26 reach the common anode electrode 15, whereby the main current flows. The main current is controlled by the signals supplied to the silicon gate layers 4. That is, the device performs switching operation. At this time, an anode loss develops at the common anode electrode 15. In order to minimize the anode loss, the anode electrode 15 is made of a thick metal plate that excels in heat-radiation property, as indicated by the broken lines shown in FIG. 6A. (In displays, the anode electrode need not be so thick.) As shown in FIG. 6A, the cold-cathode modules 19 are arranged in rows and columns, forming an array, the gate lines 18 are arranged among the columns of the modules, and the gate pads 4*b* are formed on the modules 19. Thanks to the specific arrangement of the modules 19, gate lines 18 and gate pads 4*b*, the gate-connecting wires 18, which connect the pads 4*b* to the gate lines 18, the gate interconnecting is much simplified. In other words, it is easy to connect a large number of gate pads 4*b* to the gate lines 18.

A method of providing the gate lines 18 and the cold-cathode modules 19 on the cold-cathode array supporting substrate 14 that serves as cathode electrode will be explained in detail, with reference to FIG. 7. FIG. 7 is a sectional view showing the major components of the third embodiment, i.e., a multi-module cold-cathode device.

The cold-cathode modules 19 are soldered to the cold-cathode array supporting substrate 14 with solder alloy 20. The gate lines 18 are formed on the insulating strips 21, which are formed on the array supporting substrate 14. The insulating strips 21 are made of Bakelite, Teflon (material exhibiting good heat-resistant property), Pyrex glass, or the like. The gate pad 4*b* on each cold-cathode module 19 is connected to one gate line 18 by a fine wire or ribbon made of, for example, Al or Cu, by means of ultrasonic bonding. Other wires (not shown) are provided, connecting the gate lines 18 to a gate control circuit (not shown).

Figure 7:
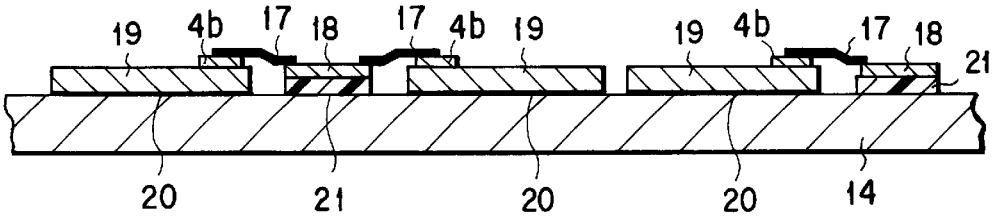
FIG. 7 is a sectional view of the cold-cathode module array used in the third embodiment of the invention.

Though not shown in FIG. 7, Al or Cu are deposited on each gate pads 4*b* and on each gate line 18, in order to facilitate the ultrasonic bonding. (This holds true for the embodiments which will be described with reference to FIGS. 8 to 12 and FIGS. 16 and 18.)

The voltage applied between each miniature emitter 26 and the silicon gate layer 4, both shown in FIG. 6B, is about 100V at most. The module substrate 1 is connected to the cathode electrode, i.e., the cold-cathode array supporting substrate 14. Hence, it suffices for the insulating strips 21 to have a withstand voltage which is about two to three times the emitter-gate voltage. Nonetheless, it is desired that the insulating strips 21 be made of heat-resistant material, such as Teflon, which has a melting point of 500° C. or more, because the strips 21 may be heated to 200° C. or more when the cold-cathode modules 19 are soldered to the cold-cathode array supporting substrate 14.

Figure 8:
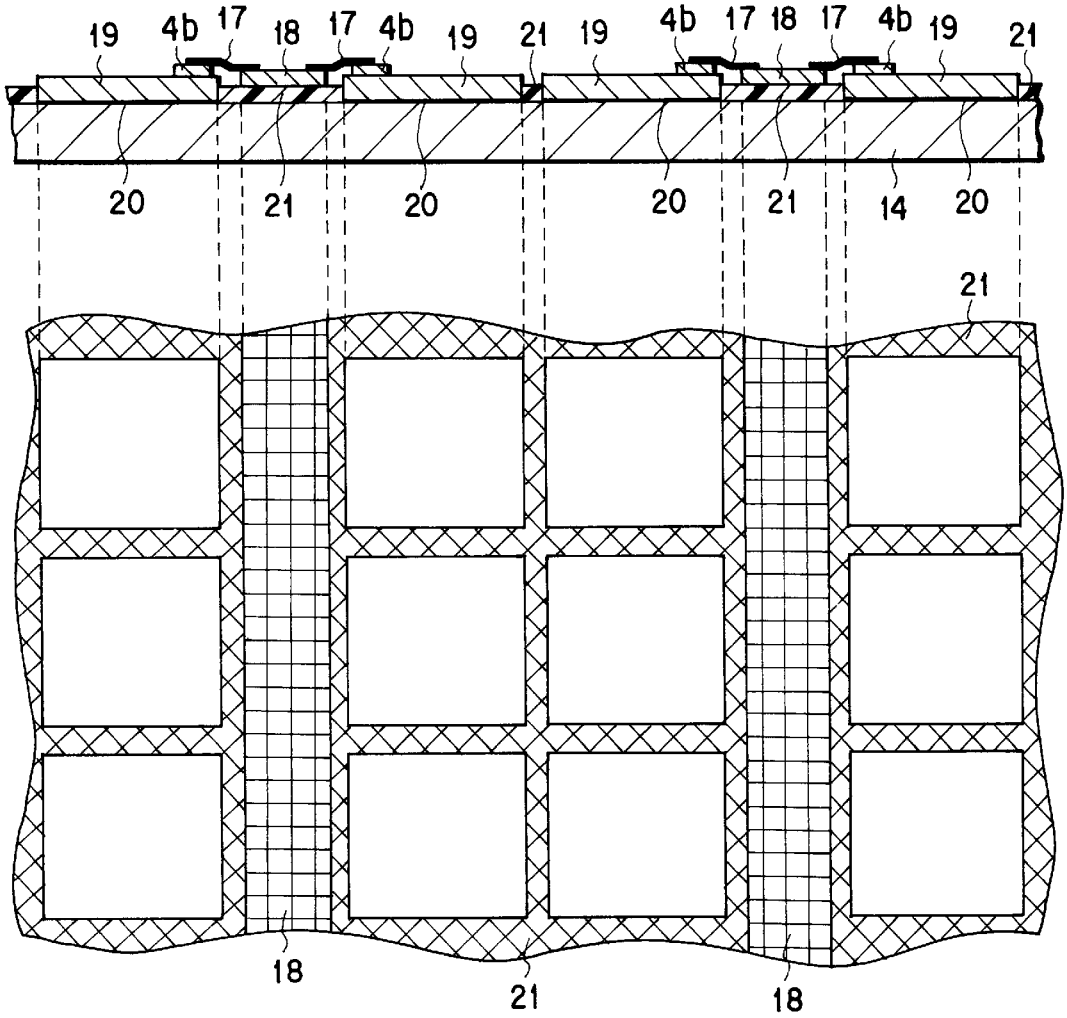
FIG. 8 is a sectional view of a cold-cathode module array and a plan view of positioning frames, both according to a fourth embodiment of the invention.

FIG. 8 shows a cold-cathode power switching device of field emission type, which is the fourth embodiment of the invention. This multi-module cold-cathode device is identical to the device shown in FIG. 7, except that a lattice-like positioning frames 21 is used in addition to the insulating strips 21. Like the strips 21, the frame 21 is made of insulating material. The frame 21 is designed to facilitate positioning cold-cathode modules 19 on the cold-cathode array supporting substrate 14.

Due to the use of the lattice-like positioning frame 21, the cold-cathode modules 19 can be easily arranged on the supporting substrate 14, at desired positions to form a matrix array. Thus, the frame 21 makes it easy to assemble the cold-cathode power switching device of field emission type. A method of manufacturing the multi-module cold-cathode device according to the fourth embodiment will be explained with reference to FIG. 8. The upper part of FIG. 8 is a sectional view of a cold-cathode module array, and the lower part of FIG. 8 is a plan view of the positioning frame 21. In FIG. 8, broken lines show the positions the frame 21 take in the sectional view and the plan view.

At first, the lattice-like positioning frame 21 is prepared, which has a plurality of square openings. It should be noted that the positioning frame 21 includes parts on which gate lines 18 will be formed. The frame 21 is fixed to the upper surface of the cold-cathode array supporting substrate 14. Then, the cold-cathode modules 19, each applied with solder alloy or conductive paste on its lower surface, are set in the square openings of the positioning frame 21. The structure comprising the supporting substrate 14, frame 21 and modules 19 is heated. As a result, the cold-cathode modules 19 are soldered to the cold-cathode array supporting substrate 14 and positioned at the desired positions, forming a matrix array.

In FIG. 8, each cold-cathode module 19 looks as if set in one square opening of the positioning frame 21, with no gap between it and the edges of the opening. Nonetheless, the square openings are slightly larger than the cold-cathode modules 19, thus providing a positioning margin which facilitate the assembling of the multi-module cold-cathode device. The precision of positioning the modules 19 falls within the positioning accuracy range of the gate-connecting wires 17. An appropriate value for the precision is about ±50 $\mu$m.

After the cold-cathode modules 19 have been fixed to the cold-cathode array supporting substrate 14, gate lines 18 are formed on those parts of the frame 21 which correspond to the insulating strips 21 of the third embodiment (FIG. 7). Further, the gate pads 4*b* formed on the modules 19 are connected to the gate lines by gate-connecting wires 17, in the same manner as in the third embodiment.

In the forth embodiment, the lattice-like positioning frame 21 includes parts on which gate lines 18 are formed, as is illustrated in the lower part of FIG. 8. The frame 21 need not have such parts if the cold-cathode modules 19 are provided in relatively small numbers and gate lines 18 are not required.

A cold-cathode power switching device of field emission type, which is the fifth embodiment of the invention, will be described with reference to FIGS. 9 and 10. The fifth embodiment is identical to the fourth embodiment (FIG. 8), except for the method of fixing cold-cathode modules 19 to the cold-cathode array supporting substrate 14.

Figure 9:
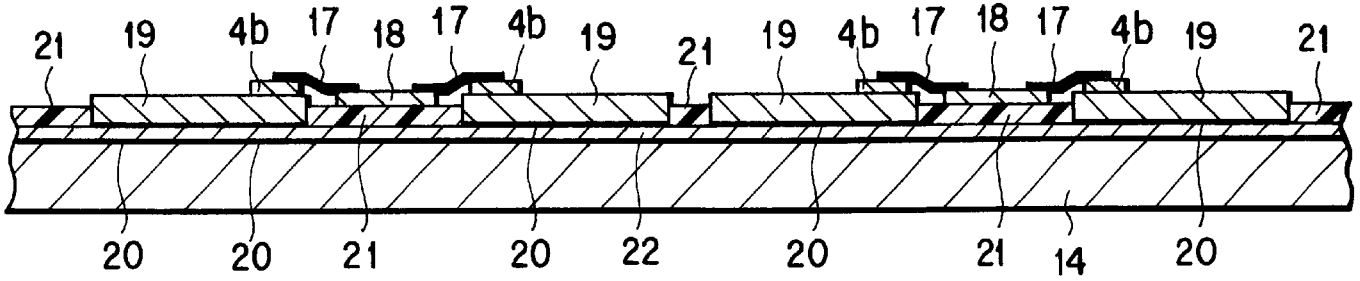
FIG. 9 is a sectional view of a cold-cathode module array according to a fifth embodiment of the present invention.
Figure 10:
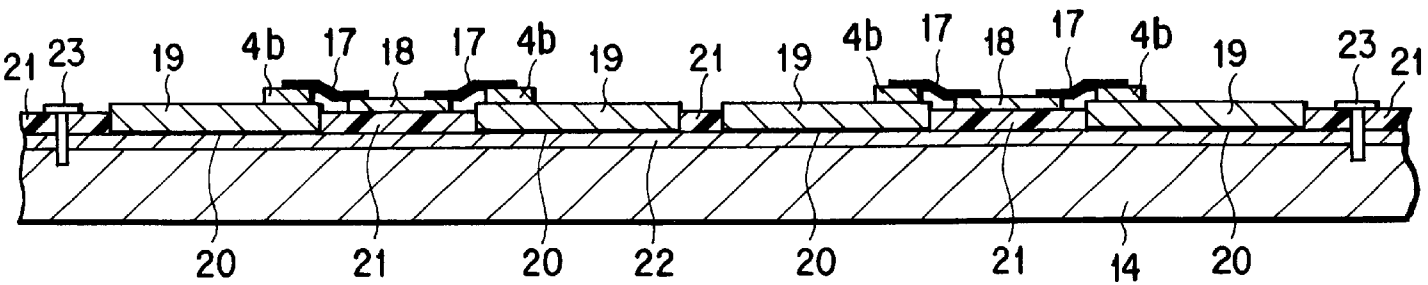
FIG. 10 is a sectional view a modification of the cold-cathode module array according to the fifth embodiment.

As shown in FIG. 9, a base 22 is prepared. Then, a lattice-like positioning frame 21 made of insulating material is fixed to the metallic base 22. The positioning frame 21 includes parts, on which gate lines 18 are formed. Cold-cathode modules 19 are then set in the square openings of the frame 21 and secured to the base 22 at prescribed positions, by using solder alloy 20. The gate pads 4*b* are connected to the gate lines 18 by gate-connecting wires 17. The process of arranging the modules 19, mounting the gate pads 4*b*, forming the gate lines 18 and connecting the pads 4*b* to the lines 18 can be reliably performed due to the use of the metallic base 22 which is rigid. In other words, the metallic base 22 severs to enhance the efficiency of assembling the power switching device.

Thereafter, the metallic base 22, on which the frame 21, modules 19, pads 4*b*, lines 18 and wires 17 are provided, is secured to the cold-cathode array substrate 14 with solder alloy 20. Conductive paste may be used, in place of the solder alloy 20, to secure the base 22 to the cold-cathode array supporting substrate 14.

The layer of solder alloy 20, securing the metallic base 22 to the supporting substrate 14 may have cracks when the temperature of the power switching device rises during the operation of the device, due to a stress resulting from the difference in thermal expansion coefficient between the metallic base 22 and the supporting substrate 14. If this happens, the power switching device will be damaged. To prevent such damage to the device, screws 23 may be used instead of the solder alloy 20, as shown in FIG. 10, to secured the metallic base 22 to the cold-cathode array supporting substrate 14. In this case, the metallic base 22 remains secured to the supporting substrate 14 even if the temperature of the device rises, despite of the difference in thermal expansion coefficient between the metallic base 22 and the supporting substrate 14.

In the third and fourth embodiments shown in FIGS. 7 and 8, respectively, each cold-cathode module 19 is soldered the cold-cathode array supporting substrate 14 at a small area. The stress resulting from the difference in thermal expansion coefficient between the metallic base 22 and the supporting substrate 14 is proportionally small, and the module 19 remains firmly secured to the cold-cathode array supporting substrate 14.

Figure 11:
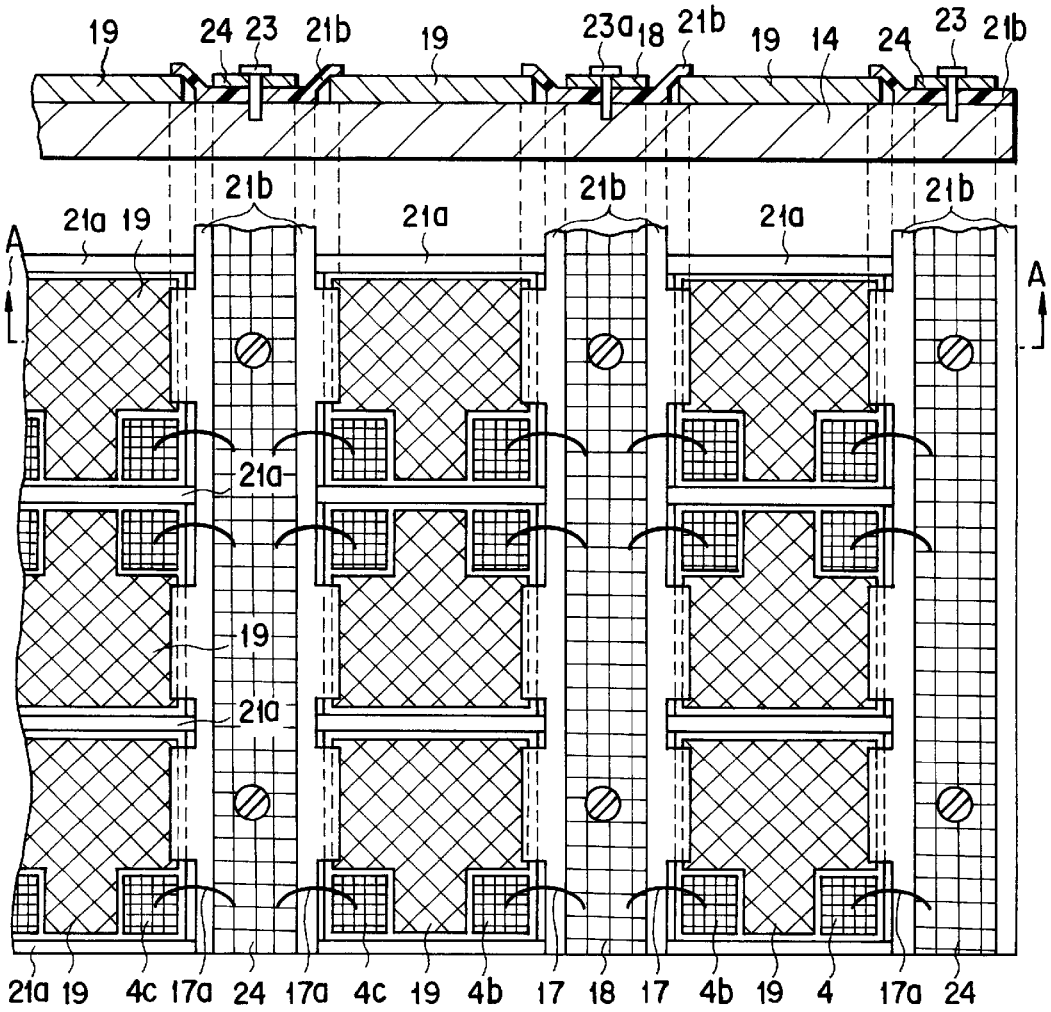
FIG. 11 is a sectional view and plan view of a cold-cathode module array according to a sixth embodiment of the invention.

A cold-cathode power switching device of field emission type, which is the sixth embodiment of the invention, will be described with reference to FIG. 11. The lower part of FIG. 11 is a plan view of the cold-cathode power switching device, and the upper apart of FIG. 11 is a sectional view of the power switching device, taken along line A—A in the plan view. The sixth embodiment is characterized in that not only a gate pad 4*b*, but also a cathode pad 4*c* is provided on each cold-cathode module 19.

Figure 2A:
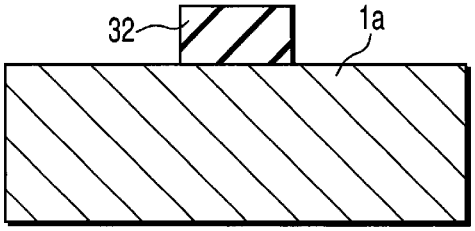
FIG. 2A (PRIOR ART)
FIGS. 2A to 2C are sectional views explaining the Gray et al. method of forming a cold-cathode emitter.
Figure 2B:
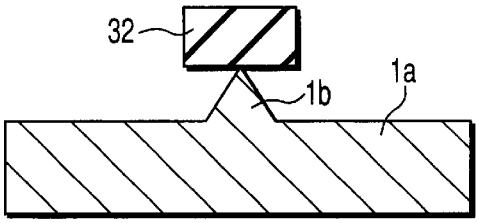
FIG. 2B (PRIOR ART)
Figure 2C:
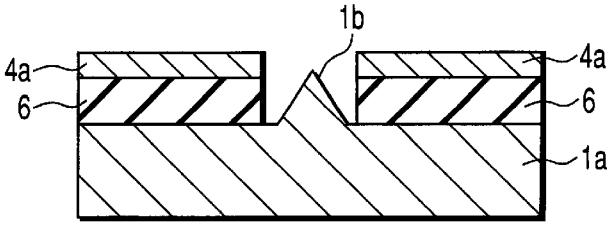
FIG. 2C (PRIOR ART)

In the sixth embodiment, the miniature emitters 26 of each cold-cathode module 19 are electrically connected to the cold-cathode array supporting substrate 14, i.e., the cathode electrode, as in the third embodiment (FIG. 6B). The module substrate 1 is electrically connected to the cathode electrode as in the third embodiment. Hence, it may seem unnecessary to provide cathode-connecting wires. Nevertheless, it is desired that cathode-connecting wires be provided, because the series resistance of the module substrate 1 is too high to neglect if the miniature emitters 26 are formed by processing a silicon substrate 1*a* as illustrated in FIGS. 2A, 2B and 2C.

As the plan view in FIG. 11 shows, insulating strips 21*b* are provided on the cold-cathode array supporting substrate 14, extending parallel to each other. Gate lines 18 (only one shown) and cathode lines 24 (only two shown) are alternately arranged, each mounted on one insulating strip 21*b*. Cathode lines 24 are mounted on the other insulating layers 21*b*. As mentioned above, a gate pad 4*b* and a cathode pad 4*c* are provided on each cold-cathode module 19. The gate pad 4*b* is connected to the nearest gate line 18 by a gate-connecting wire 17. The cathode pad 4*c* is connected to the nearest cathode line 24 by a cathode-connecting wire 17*a*.

The cathode lines 24 may not be provided, and the cathode-connecting wires 17*a* may connect the cathode pads 4*c* directly to the cathode electrode, i.e., cold-cathode array supporting substrate 14. Further, as in the fifth embodiment (FIGS. 9 and 10), a positioning frame 21 may be fixed to a metallic base 22, the modules 19 may then be set in the square openings of the frame 21, and the metallic base 22 may finally be fixed to the cathode electrode. This may facilitate the assembling of the device, ultimately enhancing the productivity of the device.

How the cold-cathode power switching device of field emission type, which is the sixth embodiment, is assembled will be explained below in detail.

As shown in the sectional view in FIG. 11, taken along line A—A in the plane view in FIG. 11, elongated insulating strips 21*a* are fixed to the upper surface of the cold-cathode array supporting substrate 14, forming a plurality of parallel rows. Other elongated insulating strips 21*b* are fixed also to the upper surface of the supporting substrate 14, extending at right angles to the rows of the insulating strips 21*a*. The strips 21*a* and the strips 21*b*, thus arranged on the supporting substrate 14, form a lattice-shaped positioning frame having square openings. The cold-cathode modules 19 are set in the openings of the positioning frame. Metal strips serving as the gate lines 18 and metal strips serving as the cathode lines 24 are laid on the insulating strips 21*b*. The gate lines 18 and some of the insulating strips 21*b* are fastened to the cathode electrode, i.e., the cold-cathode array supporting substrate 14, by means of insulating screws 23*a*. Similarly, the cathode lines 24 and the remaining insulating strips 21*b* are fastened to the cathode electrode (i.e., supporting substrate 14) by means of conducting screws 23.

As seen from the sectional view in FIG. 11, each insulating strip 21*b* has one or two projecting fins, which hold the edges of two adjacent modules 19 from above. When the strip 21*b* is fastened together with a gate line 18 or a cathode line 24 to the cathode electrode by an insulating screw 23*a* or conducting screw 23, it holds and aligns the modules 19 in a row and sets the modules 19 in press contact with the cathode electrode.

Since each cathode line 24 is fastened to the cathode electrode by the conducting screws 23, it is electrically connected to the cathode electrode with high reliability, without using wires at all. This helps to increase the space factor. On the other hand, each gate line 18 is fastened to the cathode electrode by the insulating screws 23*b*. This imparts a high withstand voltage to the interface between the gate line 18 and the cathode electrode.

In the device according to the sixth embodiment thus assembled, the cold-cathode modules 19 are arranged in rows and columns, forming a matrix array. Furthermore, the modules 19 would not peel off due to the heat generated during the operation of the switching device, despite the difference in thermal expansion coefficient between the module substrate and the supporting substrate 14. This is because the projecting fins of the insulating strips 21*b* elastically hold the modules 19 from above onto the cathode electrode. In view of this, the sixth embodiment is advantageous over the embodiments in which the cold-cathode modules are held with adhesive material such as solder.

A cold-cathode power switching device of field emission type, which is the seventh embodiment, will be described with reference to FIG. 12.

If each gate line 18 is connected to gate pads 4*b* and each cathode line is connected to cathode pads (not shown), by Al wires by means of ultrasonic bonding, the Al wires will have a sharp cutoff part each, at the end connected to the gate pad 4*b* or cathode pad. An electric field will concentrate at the sharp cutoff part of each Al wire when a high voltage is applied between the anode electrode and the cathode electrode, i.e., cold-cathode array supporting substrate 14.

The electric field thus concentrated causes discharge, which results in voltage breakdown of the device and excess emission of electrons from components other than the miniature emitters. The electric field may concentrate not only at the sharp cutoff parts of the wires, but also at any projecting parts (including the wires).

Figure 12:
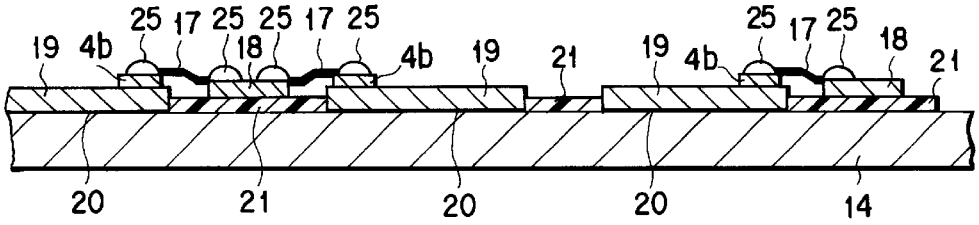
FIG. 12 is sectional view illustrating how passivation resin is applied to protect pads in a seventh embodiment of the invention.

In order to prevent the electric field from concentrating at the connection point between each wire and one gate pad 4*b* or cathode pad, the connection point is covered with a passivation layer as illustrated in FIG. 12. The passivation layer 25 has been formed by applying an insulating resin at the connection point, thus decreasing the intensity of the electric field at the connection point in inverse proportion to the dielectric constant of the insulating resin.

Figure 13:
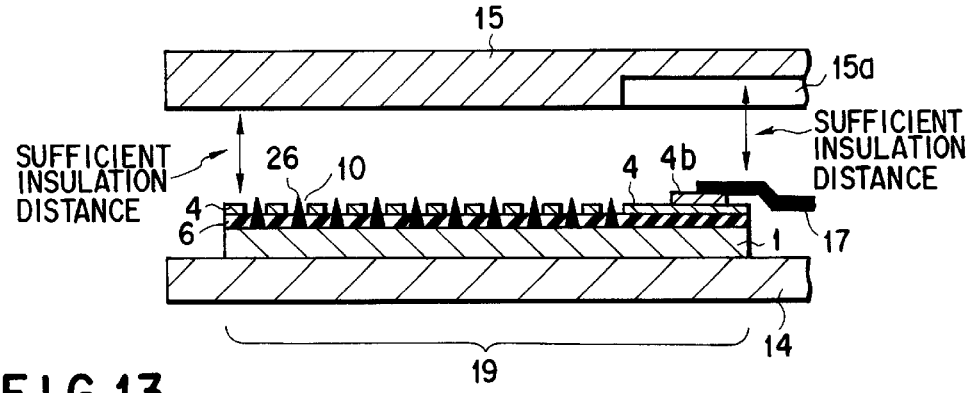
FIG. 13 is a sectional view showing the shape of the depression made in an anode electrode according to an eighth embodiment of the invention.

A cold-cathode power switching device of field emission type, which is the eighth embodiment, will be described with reference to FIGS. 13 and 14. FIG. 13 is a sectional view of one of the cold-cathode modules 19, explaining the measure taken to prevent such discharge as mentioned above.

As described above, the cathode electrode, i.e., the cold-cathode array supporting substrate 14, must be spaced away from the anode electrode 15 by a sufficient insulating distance, in order to make it possible to apply a high voltage between the cathode electrode (i.e., supporting substrate 14) and the anode electrode 15. Those parts of each cold-cathode module 19, on which the gate pad 4*b* and gate-connecting wire 17 are provided, have irregular projections, unlike on the normal surface of the module 19 from which the miniature emitters 26 protrude.

To prevent discharge from the irregular projections, it is desirable to make depressions 15*a* in the anode electrode 15 as shown in FIG. 13. Each depression 15*a* is located right above the gate pad 4*b* and gate-connecting wire 17. The distance between the wire 17 and the bottom of the depression 15*a* is therefore longer than the distance between the tip of each miniature emitter 26 and the anode electrode 15. Thus, a sufficient insulation distance is provided between every part of the cathode electrode and any part of the anode electrode 15. Hence, it is possible to prevent discharge from any projection other than the miniature emitters 26. The irregular projection on the gate pad 4*b* may be covered with a passivation layer 25 as is shown in FIG. 12. In this case, discharge from the irregular projection, which is unnecessary, can be prevented more reliably.

Discharge from each cathode pad 4*c* can be prevented, too, by making a depression in that part of the anode electrode 15 which is located right above the cathode pad 4*c*.

Figure 14:
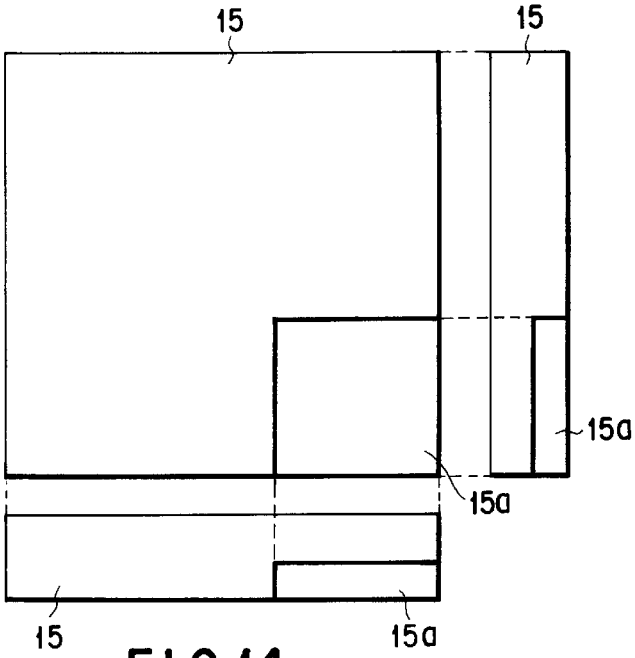
FIG. 14 is a plan view and two side views, all depicting the depression in greater detail.
Figure 15:
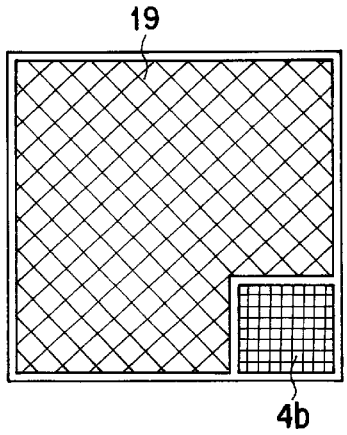
FIG. 15 is a plan view illustrating the positional relationship of the depression and the pad provided in the cold-cathode module acceding to the eighth embodiment.

FIG. 14 is a plan view and two side views, depicting where in the cathode electrode 15 the depression 15*a* is made. FIG. 15 a plan view, illustrating the positional relationship of the depression 15*a* and the gate pad 4*b* formed on the cold-cathode module 19.

A cold-cathode power switching device of field emission type, which is the ninth embodiment, will be described with reference to FIGS. 16 and 17.

Figure 16:
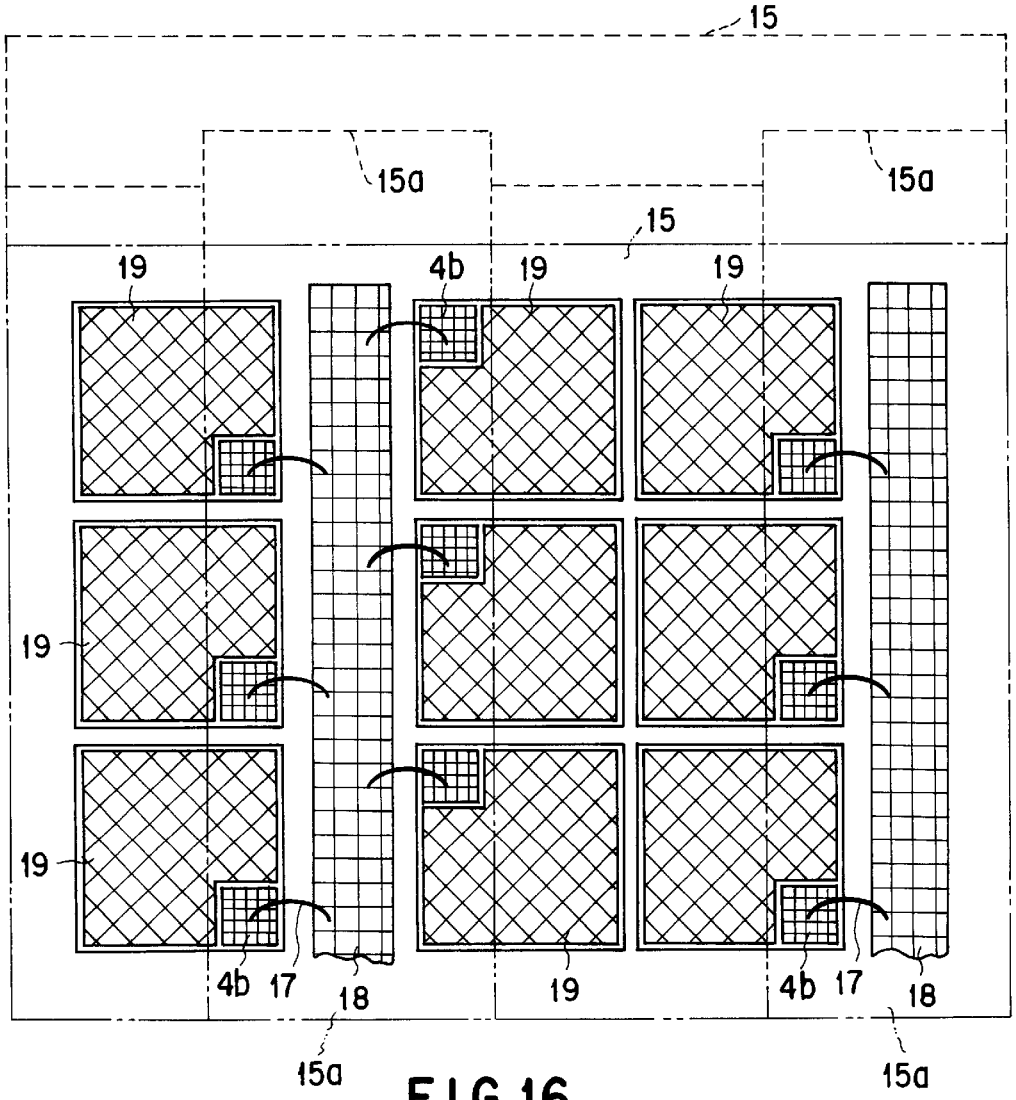
FIG. 16 is a plan view showing the trench-like depression made in an anode electrode according to a ninth embodiment of the invention.
Figure 17:
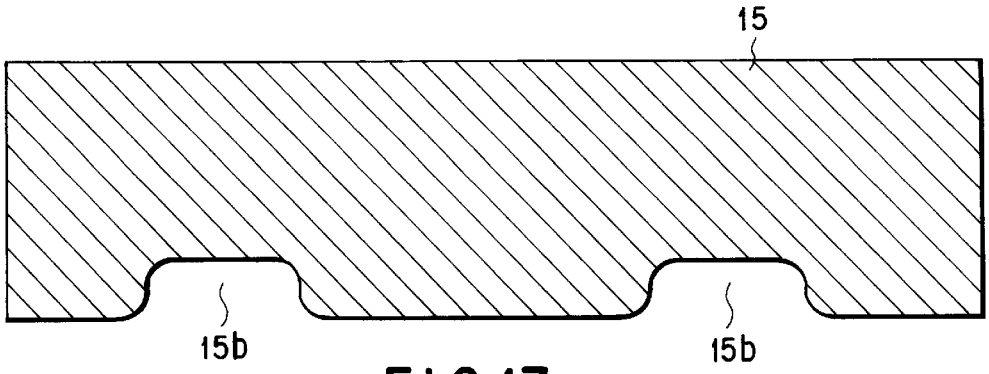
FIG. 17 is a sectional view showing a modification of the trench-like depression according to the ninth embodiment.

The ninth embodiment is characterized in that, as shown in FIG. 16, trench-like depressions 15*a* are made in the lower surface of the anode electrode 15. The depression 15*a* extend along the gate lines 18, respectively. Thus, each gate-connecting wire 17 and each gate line 18 are spaced from the bottom of the trench-like depression 15*a* by a sufficient distance. As a result, discharge is prevented from occurring, mainly at the gate-connecting wires 17 and the gate lines 18.

Trench-like depressions may be made in the lower surface of the anode electrode 15, also along the cathode lines (not shown). If so, discharge can be prevented from taking place at the cathode-connecting wires and the cathode lines. As shown in FIG. 17, trench-like depressions 15*b*, each having curved corners, may be made in the lower surface of the anode electrode 15. Discharge will not take place at the corners of each depression 15*b*, because the corners are curved.

Figure 18:
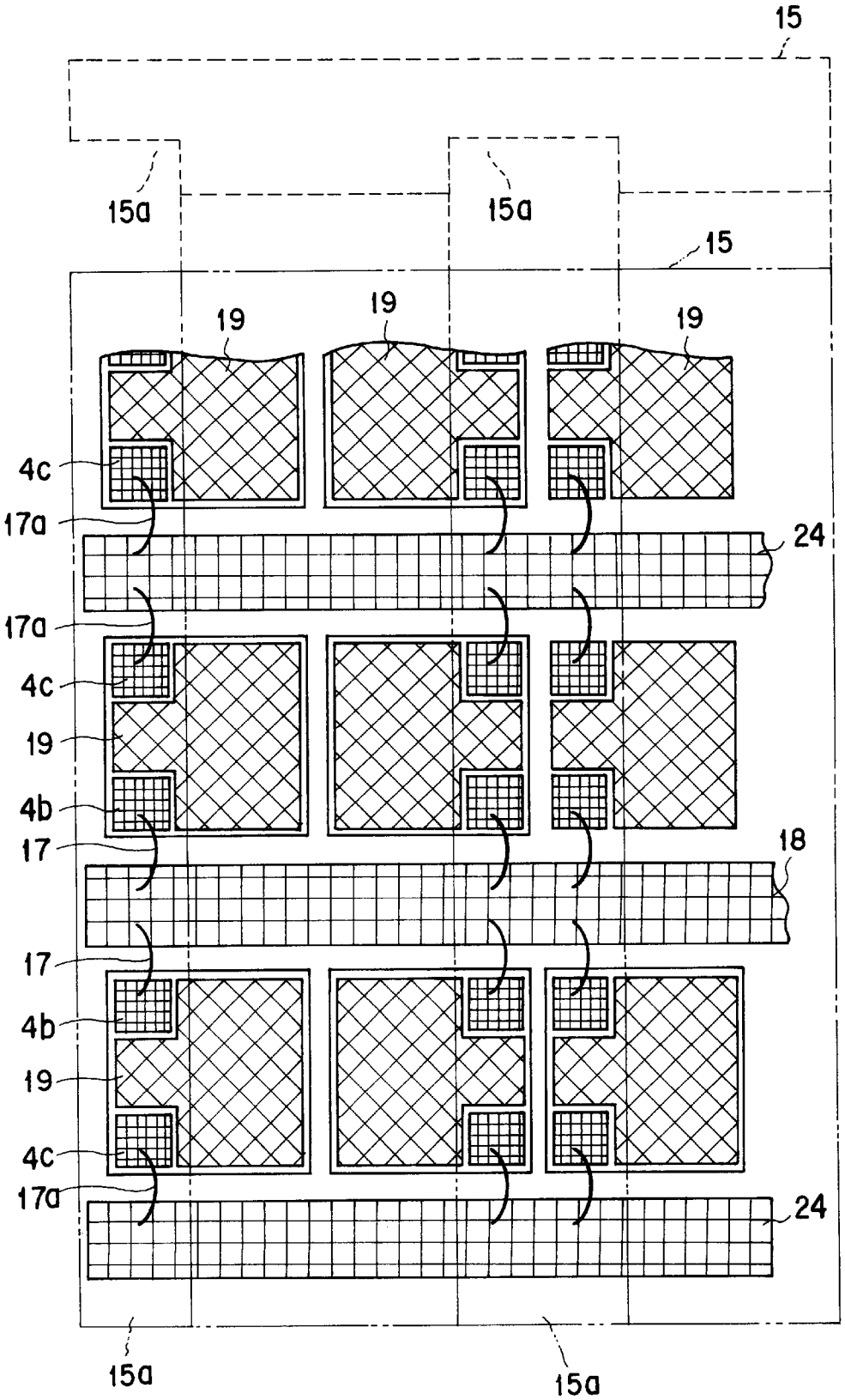
FIG. 18 is a plan view illustrating the positional relationship of the trench-like depression and the cold-cathode module array, both according to a tenth embodiment of the present invention.

A cold-cathode power switching device of field emission type, which is the tenth embodiment, will be described with reference to FIG. 18. FIG. 18 is a plan view, like FIG. 11. In FIG. 18, the anode electrode 15 is indicated by alternate two-dot, dashed lines.

A side view of the anode electrode 15 is presented in the upper part of FIG. 18. As shown in the upper part of FIG. 18, trench-like depressions 15*a* are made in the lower surface of the anode electrode 15. As can be seen from FIG. 18, each trench-like depression 15*a* is located above one column of gate pads 4*b* and cathode pads 4*c*, the gate-connecting wires 17 connecting these gate pads 4*b* to gate line 18, and the cathode-connecting wires 17*a* connecting these cathode pads 4*c* to cathode lines 24. The gate pads 4*b*, gate-connecting lines 17, cathode pads 4*c* and cathode-connecting wires 17*a* are spaced from the bottom of the trench-like depression 15*a* by a sufficient distance. Hence, discharge is prevented from occurring at the gate pads 4*b*, gate-connecting wires 17, cathode pads 4*c* and cathode-connecting wires 17*a*.

The present invention is not limited to the embodiments described above. Various changes and modifications can be made, without departing from the spirit and scope of the invention.

For example, if all cold-cathode modules tested as shown in FIG. 3N are found to be good ones, the structure of FIG. 3N can be used as a large-power switching device, with the emitter electrodes 11 set in contact with the silicon module substrate 1.

Further, the module substrate 1 may be adhered to the cold-cathode array supporting substrate 14 made of conductive material excelling in heat-radiating property, whereby heat may be radiated from the device efficiently to increase the current density in the cold-cathode power switching device.

Any one of the cold-cathode modules is found defective when the test was conducted on the structure of FIG. 5B, for each module to ascertain the insulation between the cold-cathode array supporting substrate 14 and each silicon gate layer 4 provided for one module. If this is the case, thin conductor layers 16 are formed by using thin film technology on all cold-cathode modules, but the defective one. Thus, only the good modules can be operated.

Any one of the cold-cathode modules may fail to function during the operation of the cold-cathode power switching device shown in FIG. 5D. If this happen, the device can be repaired merely by removing the thin conductor layer 16 from the defective module.

The use of good modules only and the repair of the device can be accomplished with the structure of FIG. 3N, too, by using all emitter electrodes 11, except those provided for defective modules.

The cold-cathode power switching devices of field emission type, according to the first and second embodiments, and the methods of manufacturing the first and second embodiments are advantageous in the following respects.

All cold-cathode modules formed on, for example, a 6-inch cold-cathode array substrate, can be tested at a time before the modules are separated from each other. This helps to enhance the total manufacturing yield greatly.

Of the many cold-cathode modules provided on one cold-cathode array substrate, only those free of short-circuit failure can be used. Further, emitter electrodes may be set in contact with the lower surfaces of the good cold-cathode module substrates made of conductive material, respectively, to cope with the short-circuiting of the miniature emitter arrays, each made of an emitter conductor layer.

The gate-connecting wires for the miniature emitters of each cold-cathode array need not meander on the upper surface of the cold-cathode array substrate to reduce the integration density of the module array as in the conventional cold-cathode device. Rather, the cold-cathode array supporting substrate is used as a cathode electrode so that the main current may flow from the lower surface of the cold-cathode array supporting substrate during the operation of the cold-cathode power switching device. As a result, the integration density of the cold-cathode module array increases. The operation current density of the power switching device can therefore increase.

Furthermore, no unnecessary currents are generated at the edges of the cold-cathode modules, and the release of gas is suppressed. This is because the silicon gate layer covers the upper surface of the module substrates except electron-emitting openings.

Still further, only good cold-cathode modules can be selected from the many to provide on the cold-cathode array supporting substrate and can be used to form a multi-module power switching device which has a high current density. The cold-cathode modules may be separated from each other, thereby providing a plurality of one-module power switching devices. In this case, slits are made in the module substrate beforehand, so that burrs or rip-offs may not be formed to generate leakage currents or to impair the insulation.

The slits made in the module substrate may be filled with insulating plugs and the cold-cathode modules may be separated from each other by means of dicing. If so, the insulating material covers the sides and upper peripheral region of each cold-cathode module, preventing a leakage current from flowing the sides of the module. Moreover, the substrates of the individual cold-cathode modules may be combined, forming a single unit, by filling the gaps between their sides with insulating material. Then, a thin conductor layer may be formed by thin film technology, covering the silicon gate layers of all modules. In this case, the silicon gate layers of the modules can be connected at a time by the thin conductor film, without causing short circuiting between the gate layer and miniature emitters of each cold-cathode module. The gates of the modules can be thereby connected to the gate lines, forming but very short irregular projections on the upper surface of the cold-cathode module. This serves to enhance the voltage resistance of the power device comprising the cold-cathode modules.

The cold-cathode power switching devices of field emission type, according to the third to tenth embodiments, and the methods of manufacturing the first and second embodiments are advantageous in the following respects.

The multi-module power switching device of field emission type, according to any one of these embodiments, can have high operating efficiency and can be manufactured with high assembling efficiency.

In addition, the trench-like depressions made in the lower surface of the anode electrode or in the upper surfaces of the gate pads and cathode pads increase the insulation distance between the emitters of each module and the anode electrode. The multi-module power switching device of field emission type can therefore has a high voltage resistance.

As has been described, the present invention can provide a cold-cathode power switching device of field emission type, which has a high voltage resistance, can control large currents and can have high reliability, and to a method of manufacturing this cold-cathode power switching device with high yield.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A field-emission type power device comprising:

a plurality of field-emission type cold-cathode modules; and a common anode electrode opposing the plurality of field-emission type cold-cathode modules, wherein each of said field-emission type cold-cathode modules comprises a substrate, a plurality of field-emission type emitters provided on the substrate, a gate insulating film provided on the substrate, and a gate electrode provided on the gate insulating film, said field-emission type cold-cathode modules are electrically isolated by isolating material filled in gaps between the substrates, and the gate electrodes of the modules are connected to each other by conducting films.

2. A device according to claim 1, which is designed to operated as a switching element.

3. A device according to claim 1, wherein the gate electrodes of only selected good ones of the modules are connected to each other by the conducting films.

4. A device according to claim 3, further comprising a supporting substrate which is made of conductor, which supports the field-emission type cold-cathode modules, and which imparts a common emitter potential to the field-emission type emitters of the field-emission type cold-cathode modules.

5. A field-emission type power device comprising:

a plurality of field-emission type cold-cathode modules; and a common anode electrode opposing the plurality of field-emission type cold-cathode modules, wherein each of said field-emission type cold-cathode modules comprises a substrate, a plurality of field-emission type emitters provided on the substrate, a gate insulating film provided on the substrate, and a gate electrode provided on the gate insulating film; and said field-emission type power device further comprising:

a supporting substrate supporting the field-emission type cold-cathode modules;

gate lines provided between the field-emission type cold-cathode modules; and wires connecting the gate electrodes of the field-emission type cold-cathode modules to the gate lines.

6. A device according to claim 5, which is a switching element.

7. A device according to claim 5, wherein depressions are made in those parts of the common anode electrode which oppose regions between the field-emission type cold-cathode modules.

8. A device according to claim 5, further comprising cathode lines provided between the field-emission type cold-cathode modules, and wires connecting the emitter electrodes of the field-emission type cold-cathode modules to the cathode lines.

9. A device according to claim 5, wherein the field-emission type cold-cathode modules are set in a lattice-shaped positioning frame provided on the supporting substrate.

10. A field-emission type power device comprising:

a plurality of field-emission type cold-cathode modules;

a common anode electrode opposed to the plurality of field-emission type cold-cathode modules; and a cold-cathode supporting substrate on which the field-emission type cold-cathode modules are supported;

wherein each of the field-emission type cold-cathode modules comprises a substrate, a plurality of field-emission type emitters provided on the substrate, a gate insulating film provided on the substrate, and a gate electrode provided on the gate insulating film;

the field-emission type cold-cathode modules are arranged on the cold-cathode supporting substrate, and any of heat-resistant epoxy resin, heat-resistant polyimide, and low-melting glass and ceramic paste is filled in gaps between the field-emission type cold-cathode modules; and the field-emission type power device further comprises conducting films connecting the gate electrodes of the field type cold-cathode modules to each other.

11. A device according to claim 10, which is designed to be operated as a switching element.

12. A device according to claim 10, wherein the gate electrodes of only selected good ones of the modules are connected to each other by the conducting films.

13. A device according to claim 10, wherein the cold-cathode supporting substrate is made of a conductor, and imparts a common emitter potential to the field-emission type emitters of the field-emission type cold-cathode modules.

* * * * *